US009847076B1

(12) United States Patent
McCabe

(10) Patent No.: US 9,847,076 B1
(45) Date of Patent: Dec. 19, 2017

(54) TREMOLO SPRING AND STABILIZER TUNER

(71) Applicant: Geoffrey Lee McCabe, Hollywood, CA (US)

(72) Inventor: Geoffrey Lee McCabe, Hollywood, CA (US)

( * ) Notice: Subject to any disclaimer, the term of this patent is extended or adjusted under 35 U.S.C. 154(b) by 0 days.

(21) Appl. No.: 15/296,401

(22) Filed: Oct. 18, 2016

(51) Int. Cl.
*G10D 3/14* (2006.01)
*G10D 3/04* (2006.01)
*G10D 1/08* (2006.01)

(52) U.S. Cl.
CPC ..... *G10D 3/146* (2013.01); *G10D 1/085* (2013.01); *G10D 3/04* (2013.01)

(58) Field of Classification Search
CPC ..... G10D 3/146; G10D 1/085; G10D 3/04
See application file for complete search history.

(56) References Cited

U.S. PATENT DOCUMENTS

| | | | |
|---|---|---|---|
| 16,995 | A | 4/1857 | Randle |
| 644,987 | A | 3/1900 | Lyon |
| 936,624 | A | 10/1909 | Hale |
| 1,113,390 | A | 10/1914 | Wenzel-Schmidt |
| 1,253,550 | A | 1/1918 | Wilkins |
| 1,416,568 | A | 5/1922 | Mazzocco |
| 1,475,345 | A | 11/1923 | Lambert et al. |
| 1,626,753 | A | 5/1927 | Carlson et al. |
| 1,684,057 | A | 9/1928 | Fisher |
| 2,070,916 | A | 2/1937 | Peate |
| 2,130,248 | A | 9/1938 | Peate |
| 2,191,776 | A | 2/1940 | Schreiber |
| 2,254,012 | A | 8/1941 | Kudo |
| 2,262,179 | A | 11/1941 | Hammond |
| 2,453,572 | A | 11/1948 | Ferrier |
| 2,514,835 | A | 7/1950 | Bredice |
| 2,736,226 | A | 2/1956 | McBride |
| 2,741,146 | A | 4/1956 | Fender |
| 2,844,985 | A | 7/1958 | Ferriera |
| 2,873,640 | A | 2/1959 | Kunz |
| 2,973,682 | A | 3/1961 | Fender |
| 2,976,755 | A | 3/1961 | Fender |
| 3,136,198 | A | 6/1964 | Smith et al. |
| 3,313,196 | A | 4/1967 | Mari |
| 3,403,588 | A | 10/1968 | Downing |
| 3,407,696 | A | 10/1968 | Smith et al. |
| 3,437,001 | A | 4/1969 | Kraft |
| 3,575,078 | A | 4/1971 | Currier |
| 3,580,525 | A | 5/1971 | Dopner |
| 3,583,272 | A | 6/1971 | Eurich |
| 3,584,807 | A | 6/1971 | Smith |
| 3,599,524 | A | 8/1971 | Jones |

(Continued)

*Primary Examiner* — Kimberly Lockett

(57) ABSTRACT

The Stabilizer Tuner adjustably supports a formed spring or a pre-loaded coil spring element operable to hold a variable force of tension to enforce initial position. The Tremolo Stabilizer includes a thumbwheel arrangement to variably adjust the position of an independent stabilizer arrangement. Tremolo Spring Tuner includes a pre-loaded coil spring element or formed flat spring operable to exert a first variable force of tension to contact the body with the capacity to variably support the pivoting of tremolo under the variable force of the string tension; the first force of tension is essentially equal to the force of tension provided by the strings to establish the fulcrum tremolo at initial position.

21 Claims, 9 Drawing Sheets

(56) References Cited

U.S. PATENT DOCUMENTS 3,667,336 A 6/1972 Itzler et al.
3,678,795 A 7/1972 Fullerton
3,688,631 A 9/1972 Jackson
3,695,137 A 10/1972 Eurich
3,763,736 A 10/1973 Williams
3,780,612 A 12/1973 Robinson
3,911,777 A 10/1975 Rendell
3,911,778 A 10/1975 Martin
3,915,049 A 10/1975 Bean
3,924,820 A 12/1975 Kovar et al.
4,027,570 A 6/1977 Rendell et al.
4,037,506 A 7/1977 How
4,111,093 A 9/1978 Field et al.
4,120,462 A 10/1978 Raasch et al.
4,129,154 A 12/1978 Bennelli
4,130,045 A 12/1978 Walker
4,135,426 A 1/1979 Rickard
4,137,812 A 2/1979 Franzmann
4,138,919 A 2/1979 Miller
4,142,435 A 3/1979 Pozar
4,161,903 A 7/1979 Sokol
4,170,161 A 10/1979 Kaftan
4,171,661 A 10/1979 Rose
4,201,108 A 5/1980 Bunker
4,206,679 A 6/1980 Wilson
4,208,941 A 6/1980 Wechter
4,234,133 A 11/1980 Enneking
4,241,637 A 12/1980 Brent
4,283,982 A 8/1981 Armstrong
4,304,163 A 12/1981 Siminoff
4,348,934 A 9/1982 Ogata
4,366,740 A 1/1983 Tripp
4,375,180 A 3/1983 Scholz
4,377,101 A 3/1983 Santucci
4,389,917 A 6/1983 Tiebout, III
4,425,831 A 1/1984 Lipman
4,426,907 A 1/1984 Scholz
4,433,603 A 2/1984 Siminoff
4,457,201 A 7/1984 Storey
4,462,295 A 7/1984 Hundley
4,472,994 A 9/1984 Armstrong
4,475,432 A 10/1984 Stroh
4,497,236 A 2/1985 Rose
4,522,101 A 6/1985 Peavey et al.
4,546,306 A 10/1985 Alba et al.
4,549,130 A 10/1985 Dobberstein
4,549,461 A 10/1985 Rose
4,555,970 A 12/1985 Rose
4,573,391 A 3/1986 White
4,608,904 A 9/1986 Steinberger
4,608,905 A 9/1986 Takabayashi
4,608,906 A 9/1986 Takabayashi
4,623,101 A 11/1986 Cacak
4,632,005 A 12/1986 Steinberger
4,638,708 A 1/1987 Kamal
4,638,711 A 1/1987 Stroh
4,648,304 A 3/1987 Hoshino et al.
4,656,915 A 4/1987 Osuga
4,672,877 A 6/1987 Hoshino et al.
4,674,389 A 6/1987 Fender
4,677,891 A 7/1987 Gressett, Jr. et al.
4,681,011 A 7/1987 Hoshino
4,690,027 A 9/1987 Ido
4,696,218 A 9/1987 Hoshino et al.
4,704,935 A 11/1987 Franklin
4,712,463 A 12/1987 Kubicki et al.
4,724,737 A 2/1988 Fender
4,760,622 A 8/1988 Rohrman
4,762,046 A 8/1988 Aspri et al.
4,768,415 A 9/1988 Gressett, Jr. et al.
4,779,506 A 10/1988 Takeuti
4,793,236 A 12/1988 McGuire et al.
4,803,906 A 2/1989 Fender
4,840,102 A 6/1989 Pittman
4,854,210 A 8/1989 Palazzolo
4,856,404 A 8/1989 Hughes, Sr.
4,869,145 A 9/1989 Evans
4,876,794 A 10/1989 Myers
4,882,967 A 11/1989 Rose
4,903,568 A 2/1990 Itoh
4,905,563 A 3/1990 Davies
4,909,126 A 3/1990 Skinn et al.
4,928,564 A 5/1990 Borisoff et al.
4,939,970 A 7/1990 Hoshino et al.
4,945,801 A 8/1990 Stroh et al.
4,955,275 A 9/1990 Gunn
4,967,631 A 11/1990 Rose
4,982,640 A 1/1991 Buscarino
5,012,716 A 5/1991 Pagelli
5,014,588 A 5/1991 Omata et al.
5,033,353 A 7/1991 Fala et al.
5,040,741 A 8/1991 Brown
5,052,269 A 10/1991 Young, Jr.
5,072,646 A 12/1991 Valkama
5,080,295 A 1/1992 Hongo et al.
D324,693 S 3/1992 Rose
5,095,797 A 3/1992 Zacaroli
5,097,737 A 3/1992 Uhrig
5,123,326 A 6/1992 Clevinger
5,125,311 A 6/1992 Boulanger et al.
5,127,298 A 7/1992 Snape et al.
5,136,918 A 8/1992 Riboloff
5,140,884 A 8/1992 Bowden
5,171,927 A 12/1992 Kubicki et al.
5,173,565 A 12/1992 Gunn
5,191,159 A 3/1993 Jordan
5,198,601 A * 3/1993 McCabe ..... G10D 3/146 84/298
5,227,571 A 7/1993 Cipriani
5,265,512 A 11/1993 Kubicki et al.
5,277,095 A 1/1994 Steinberger
5,277,373 A 1/1994 Morton
5,284,396 A 2/1994 Masumura et al.
5,293,804 A 3/1994 Myers
5,295,427 A 3/1994 Johnsen et al.
5,323,680 A 6/1994 Miller et al.
5,337,643 A 8/1994 Cantrell
5,343,793 A 9/1994 Pattie
5,347,904 A 9/1994 Lawrence
5,347,905 A 9/1994 Cipriani
5,353,672 A 10/1994 Stewart
5,355,759 A 10/1994 Hoshino
5,359,144 A 10/1994 Benson
5,361,667 A 11/1994 Pritchard
5,372,057 A 12/1994 Hart
5,377,926 A 1/1995 Min
5,390,578 A 2/1995 Raymer
5,390,579 A 2/1995 Burgon
5,398,581 A 3/1995 Castillo
5,410,936 A 5/1995 Ellsworth et al.
5,413,019 A 5/1995 Blanda, Jr.
5,419,227 A * 5/1995 Lavineway ..... G10D 3/146 84/313
5,421,233 A 6/1995 Bunker
5,431,079 A 7/1995 Bunker
5,438,901 A 8/1995 Sperzel
5,452,637 A 9/1995 DeCola
5,458,035 A 10/1995 Okamura
5,460,072 A 10/1995 Ferdon
5,477,764 A 12/1995 Carrico
5,477,765 A 12/1995 Dietzman
5,519,165 A 5/1996 Gregory
5,522,299 A 6/1996 Rose
5,537,907 A 7/1996 Rose
5,539,143 A 7/1996 Rose
5,539,144 A 7/1996 Sherman
5,549,027 A 8/1996 Steinberger et al.
5,567,895 A 10/1996 Aspri et al.
5,567,903 A 10/1996 Coopersmith et al.
5,589,653 A 12/1996 Rose
5,600,078 A 2/1997 Edwards
5,614,688 A 3/1997 Donnell
5,631,432 A 5/1997 Muncy
5,637,818 A 6/1997 Fishman et al.

(56) References Cited

U.S. PATENT DOCUMENTS 5,637,820 A 6/1997 Wittman
5,637,823 A 6/1997 Dodge
5,661,252 A 8/1997 Krawczak
5,672,835 A 9/1997 Doughty
5,679,910 A 10/1997 Steinberger et al.
5,684,256 A 11/1997 Rose
5,689,075 A 11/1997 Rose
5,696,335 A 12/1997 Rose
5,700,965 A 12/1997 Rose
5,705,760 A 1/1998 Rose
5,717,150 A 2/1998 Rose
5,734,117 A 3/1998 Tanzella
5,739,444 A 4/1998 Borisoff
5,756,913 A 5/1998 Gilmore
5,824,925 A 10/1998 Yost
5,824,929 A 10/1998 Freeland et al.
5,859,378 A 1/1999 Freeland et al.
5,880,383 A 3/1999 Huff
5,886,270 A 3/1999 Wynn
5,945,615 A 8/1999 Rose
5,959,224 A 9/1999 McCune
5,965,831 A 10/1999 McCabe
5,986,191 A * 11/1999 McCabe ..... G10D 3/146 84/313
RE36,484 E 1/2000 Turner
6,034,311 A 3/2000 Fisher, IV
6,046,393 A 4/2000 Rose
6,046,397 A 4/2000 Rose
6,051,773 A 4/2000 Rose
6,069,306 A 5/2000 Isvan et al.
6,084,166 A 7/2000 Lee
6,111,176 A 8/2000 Rose
6,137,039 A 10/2000 Rose
6,175,066 B1 1/2001 McCabe
6,194,645 B1 2/2001 Rose
6,198,030 B1 3/2001 Rose
6,283,397 B1 9/2001 Chen
6,384,311 B1 5/2002 Cota
6,420,639 B1 7/2002 Sherlock
6,437,226 B2 8/2002 Oudshoorn et al.
6,552,252 B2 4/2003 Hirayama
6,563,034 B2 5/2003 McCabe
6,686,524 B2 2/2004 Hirayama
6,723,904 B1 4/2004 Dolan et al.
6,825,406 B2 11/2004 Thidell
7,053,287 B2 5/2006 Dam
7,189,908 B2 3/2007 Lavineway
7,235,729 B2 6/2007 Minakuchi
7,235,730 B2 * 6/2007 Hirayama ..... G10D 3/146 84/307
7,297,851 B2 11/2007 Caldwell et al.
7,427,703 B2 9/2008 Geier
7,470,841 B1 * 12/2008 McCabe ..... G10D 3/146 84/312 R
7,479,592 B1 1/2009 Slavik
7,534,950 B2 5/2009 Lyles
7,541,528 B2 6/2009 Lyles
7,554,023 B2 6/2009 Tyler
7,579,536 B2 8/2009 Bonebrake
7,592,528 B2 9/2009 Lyles et al.
7,632,997 B2 12/2009 Small et al.
7,692,079 B2 4/2010 Lyles
7,718,873 B1 5/2010 Slavik
7,820,898 B2 10/2010 Bayliss
7,855,330 B2 12/2010 Lyles et al.
7,888,570 B2 2/2011 Lyles et al.
8,946,529 B2 2/2015 Rose
2002/0194977 A1 12/2002 Hirayama
2003/0094087 A1 5/2003 Gregory
2003/0226441 A1 12/2003 Barney
2006/0117930 A1 6/2006 Folmar et al.
2007/0006712 A1 1/2007 Lyles
2007/0012161 A1 1/2007 Lyles
2007/0214931 A1 9/2007 Lyles
2007/0214935 A1 9/2007 Lyles
2007/0289429 A1 12/2007 Tyler
2008/0196571 A1 8/2008 Lyles
2009/0183619 A1 7/2009 Lyles et al.
2009/0301283 A1 12/2009 Lyles et al.
2012/0285312 A1 11/2012 Lyles et al.
2013/0167705 A1 7/2013 Lyles et al.
2013/0220099 A1 8/2013 Lyles et al.
2014/0020544 A1 1/2014 Lyles et al.

* cited by examiner

TREMOLO SPRING AND STABILIZER TUNER

GENERAL BACKGROUND OF THE INVENTION

In a stringed musical instrument, such as a guitar, the strings, placed under tension, extend unsupported between a first critical point usually formed by the nut positioned where the neck joins the head and a second critical point usually formed by a clearly defined point on the bridge positioned on the body. The strings are secured or fixed at one end on the body of the instrument to what is traditionally known as the tailpiece, strung over the bridge and extended past the nut at the transition from the neck instrument to the head, and, for conventional instruments, secured at the other end to the tuning pegs where a string is tensioned and adjusted to a tuned pitched condition, tensioned for play, or, simply, tuned condition; sometimes a nut arrangement is provided for a headless or tuning peg-less design. The neck further comprises a fingerboard or fret board that a player presses the strings against to play various pitches up and down the neck; the fingerboard typically is formed with a convex radius that commonly varies between 9" and 16".

The second critical point can be created as a part of a bridge or combined bridge and tailpiece structure. Traditionally, the size of the bridge element is quite small so as to create a clearly defined single point of contact between the string and the bridge element. It is between these two points that the playable string length is typically determined, sometimes referred to as the scale length or harmonic length. Adjusting the relative distance between the first and second critical points is called harmonic tuning or setting the intonation. Some bridges structures are individually adjustable, that is for each string, relative to the nut for achieving a more precise harmonic tuning. Usually this adjustment of the second critical point for harmonic tuning is carried out first and then the strings of the instrument are tuned to playing pitch. Often referred to the "initial setup", it is not uncommon that further adjustment of the harmonic tuning is necessary for a variety of reasons, for example, including changing the brand of a string where the alloy of the strings is varied or when the gauge of strings the player chooses changes as well as "setting" the string by manually pulling on the string along the scale length in order to improve elasticity in the string at first tensioning before the string can confidently relied on to hold proper playing pitch during the life of the string.

Often the typical construction of the strings, particularly for guitar and bass, includes a plain end and, on the other end, a "ball end" which being a washer-like addition is wrapped by the string itself into a larger form to enable "fixing" or securing the string on the instrument to the tailpiece element; alternatives to the "ball end" include as known to those of ordinary skill in the art as "bullet ends" formed from metal and molded around the end of the string. The tailpiece is usually provides for an opening or recess sufficient in size to receive the strings of various diameters ranging from 0.007" to 0.070" or more while being smaller than the diameter of the ball end so as to limit the passing of the ball end through the opening or recess in order to secure or mount each of the individual strings to the body. The wrapping usually extends up to a ½" towards the plain end and as such the position of the tailpiece structure relative to the bridge element must insure that the wrapping does not extend over the second critical point when arranged on the instrument; this wrapping, under normal circumstances, is not subject to stretch compared to the rest of the string. In the relevant art, "anchoring" strings is often referred to as attaching or securing a string and understood with the limitation that the anchoring is sufficient so that the string is fixedly attached or secured to the instrument under the typical tensioned conditions of the string that typically range from 16 to 20 lbs or greater. Stable fine adjustments of these and other elements have been a longstanding problem for stringed musical instruments.

Additionally, the popularity of guitars and other multi-stringed instruments having more than the typical 6 strings and/or using longer scale lengths, etc. are capable of a greater pitch range which creates the need for strings of a larger diameter. One solution is to utilize "taper core strings" that have one or two less layers of wrap near the "ball end" of the string to go over the bridge elements. Further, a "taper wound" string simply tapers away these layers of wrap as near the ball-end of the string, so the part that goes over the bridge has a smaller diameter. "Exposed core" strings taper down to the core itself, so the core goes over the bridge and lowers the action and increases sustain/resonance. These designs are often seen on B strings, typically a low string on a five string bass, for example. The logic is that a taper core string, etc. approach will help with intonating a larger diameter string. In some of these cases the strings are mounted to tailpiece portion by inserting the string through or over the bridge elements to avoid complications due to increased string diameter. The larger diameters can be problematic given the dimensions of vintage systems.

Playing pitch or proper playing pitch or pitched string condition is generally understood by one of ordinary skill in the art to be the proper pitch of a guitar string relative to the remaining guitar strings when a guitar is played "in tune." For example, in a standard tuning arrangement, for a six string guitar, based on the standard A=440 Hz, the playing pitch of the $1^{st}$ string (highest) is tuned to note E (329.63 Hz), the playing pitch of the $2^{nd}$ string is tuned to note B (294.94 Hz), the playing pitch of the $3^{rd}$ string is tuned to note G (196.00 Hz), the playing pitch of the $4^{th}$ string is tuned to note d (146.83 Hz), the playing pitch of the $5^{th}$ string is tuned to note A (110 Hz), and the playing pitch of the $6^{th}$ string is tuned to note E (82.41 Hz).

In the Proelsdorfer U.S. Pat. No. 2,304,597, string tensioning devices placed on the tailpiece for fine tuning the pitch of the strings of violins, guitars and the like, were disclosed; such pitch adjustment is quite limited in range, comprising generally an interval falling between that of a whole tone and a major third at best, and designed to offer the tuning of the strings a minor adjustment of pitch after the general tuning is achieved with the tuning pegs on the head of the instrument which traditionally first provides for raising and adjusting the tension of the strings to pitch from an untensioned condition and then setting the string. This is regarded as fine tuning and the apparatus for doing so, the "fine tuners", usually comprise an adjustment knob or thumb screw.

It is known to those skilled in stringed musical instrument design and construction that various tremolos have been proposed and utilized for varying the tension of all the strings simultaneously for the purpose of creating a tremolo sound. Further, it is known to those skilled in the art that there are a great many commonly used names for such devices, such as tremolo, tremolo device, tremolo tailpiece, tremolo bridge, fulcrum tremolo, fulcrum tremolo bridge, fulcrum tremolo tailpiece, fulcrum tremolo bridge-tailpiece, vibrato, vibrato bridge, vibrato tailpiece, vibrato bridge tailpiece, etc.

In one specific species, known as the fulcrum tremolo, first introduced in Fender U.S. Pat. No. 2,741,146 ("Fender '146") shows and provides a device comprising a novel structure, which incorporates the bridge and the tailpiece. The portion supporting the bridge elements is called the bridge plate or the base plate. Further, both the bridge and the tailpiece elements connected to the base plate both move together as the fulcrum tremolo device is pivoted. Typically, in order to facilitate the fulcrum tremolo pivoting about its fulcrum axis, counter springs, as a biasing element, are utilized to counteract or counter balance the pull of the strings. Accordingly, a singular and defining aspect of the fulcrum tremolo is that the harmonic tuning is upset as the device is pivoted; and, accordingly, for an instrument equipped with a fulcrum tremolo, it is unique in that only restoring all of the strings to a proper pitched condition also simultaneously restores the harmonic tuning for all the strings. The base plate upon which the individual bridge elements are adjustably secured has a beveled ridge portion which is secured to the instrument body by six screws permitting pivotal movement about a fulcrum axis which varies the tension on the strings and produces the desired "tremolo effect"; in general, this device allowed for extensive dropping down of the pitch of all the strings and a modest upward capacity that further enabled the familiar mild pedal steel or Hawaiian guitar vibrato effect provided in gentle pivoting.

In this first vintage fulcrum tremolo, herein referred to as Type I, the metal bridge elements of Fender '146 are loosely held in place by a spring loaded attachment screw arrangement pivotally secured through openings in a small folded portion of the base plate farthest from the fulcrum axis. The bridge elements also incorporate set screws for varying the relative height of the bridge elements and, therefore, height of the respective second critical points relative to the base plate and by extension, to the body and neck.

The fulcrum tremolo is generally defined to have a base plate pivotally mounted to the body of the instrument and an "inertia block" or "tone block" or "spring block" that extends transverse the direction of the strings 90° to the base plate. The instrument body is fashioned to include a single body cavity comprising two distinctive sections. There is 1) an approximate 3.00"×1.00", generally rectangular, transverse the direction of the strings, traditional "tremolo pocket" or "trem pocket" extending generally perpendicular from the top surface of the body to meet at 90° providing two approximate 3.00" wide opposing faces, a first face closer the nut and a second face further the nut; and 2) the traditional, generally rectangular, approximate 4.00"×2.25"×0.775" deep, cutout extending in the direction of the strings in the back of the instrument body, a "spring pocket", to receive the spring arrangement. The spring block has a first surface closet the nut and a second surface, each surface generally perpendicular to the top of the instrument and generally parallel to the tremolo pocket first and second face. Although there are differences in specifications from one instrument manufacturer to another for the various designs of the fulcrum tremolos that are available, there is approximately 0.125" to 0.250" clearance, between the spring block and the tremolo pocket face closest to the nut, to provide for upward pitch change as the spring block pivots towards the nut. Counter springs are usually connected to the body of the instrument at one end and, on the other end, to a separate spring attachment means transverse the base plate, usually a block of metal, milled or cast or a combination of the two, which being secured to the bottom of the base plate by three screws 90 degrees to the base plate, is often called a spring block or inertia block.

The typical spring arrangement includes, in addition to the biasing springs connected to the spring block, a "spring claw" to receive the other end of the biasing element secured by two wood screws to adjust the position of the spring claw relative to the body for a simple but cumbersome adjustment method. There is ample room for the spring block to pivot freely within the "tremolo pocket" cavity during use.

One of the most troublesome problems with prior art for the fulcrum tremolo has been maintaining the "initial position" achieved at "initial setup" when all the strings are brought to proper playing pitch as the harmonic tuning is achieved. When a musician plays on the string there is usually some kind of string stretch over time that results in the overall tuning, and thereby, the "initial position" going out of balance. Specifically, when the pitch of the string changes, the position of the fulcrum tremolo and the position of the second critical point relative to the nut changes which then instantly alters the harmonic tuning. This is especially problematic if a string breaks with this type of tremolo; since the missing force otherwise created by the tension of the broken string allows the entire tremolo to be subject to the known "backward tilt", all the remaining strings are unmanageably sharp in pitch and the harmonic relationship to the fret placement and scale length is distorted, generally, to an undesirable degree. Furthermore, when the tremolo base plate tilts forward, the spring block tilts away from the nut; and when the tremolo base plate tilts rearward, the spring block tilts towards the nut.

This singular characteristic adds complexities in obtaining the primary goal of achieving a stable equilibrium, initial position, between the force of the tension provided by the use of two to five biasing or counter springs (connecting between the tremolo and the body) in relation to the force of tension of all the strings (connected to the fulcrum tremolo and the end of the neck at the peg head by the tuning pegs or an optional nut arrangement that secures the strings without tuning pegs, etc.)

Accordingly, these and other inherences need to be addressed in achieving a true and lasting initial position for the fulcrum tremolo and has been the object of many inventions. In this inherent inter-dependant system of tensioning forces, contrary to the requirements of other tremolo or fixed bridge arrangements, (in the ideal instance where the essential conditions of the initial setup have been established and the appropriate tensioning force of the springs provisioned), the precise tensioning to proper playing pitch for any less than the total number of strings will inherently fail to achieve pitch and harmonic tuning for all of those strings attached to the tremolo.

Often the pivot is subject to wear and the tremolo does not always return to its initial position. Great care is required to establish the initial position, since both aspects of adjustment are interactive for "floating tremolo setups", and since it simultaneously provides both the proper harmonic tuning and proper pitch tuning for each of the individual strings in order to enable a lasting "initial setup".

Therefore, for stringed musical instruments, as is known to those skilled in the art:

The second critical point is a clearly defined point on the bridge or individual bridge elements, the adjustment of which relative to the first critical point on the nut defines the length of the string or scale length and the adjustment of which is called harmonic tuning.

For fulcrum tremolos as originated by Fender U.S. Pat. No. 2,741,146, when pivoted:

- Both the bridge portions and the string anchoring means, the tailpiece, simultaneously move about a common fulcrum axis;
- The harmonic tuning is upset and is only restored when all strings are at proper playing pitch;
- The tuning pegs or other means of tensioning the strings are inter-dependant with each other in obtaining initial position; and
- Various factors can disturb the equilibrium point between the tension of the strings and the tension of the counter springs and as a consequence disturb the initial position.

For those fulcrum tremolos equipped with fine tuners as with Rose U.S. Pat. No. 4,497,236, Storey U.S. Pat. No. 4,472,750 and Fender U.S. Pat. No. 4,724,737:

- The bridge and tailpiece portions simultaneously move about the fulcrum axis when the device is pivoted for the tremolo effect;
- The fine tuner screws simultaneously move with the bridge and tailpiece portions about the tuning axis when fine tuning; and
- Fine tuners are designed to offer the tuning of the strings a minor adjustment of pitch after the general tuning is first achieved, typically, by the tuning pegs on the head of the instrument; and
- Adjusting the tension of a string by the fine tuner knob alone simultaneously adjusts the harmonic and pitch tuning and can achieve tuning a string to proper pitch conditions while simultaneously achieving proper harmonic tuning.

Improvements to the Fender '146 fulcrum tremolo have included Rose's "string clamps" at the nut, installed along with a "string tree" for some guitars, a horizontal bar positioned between the tuners and the "locking nut" arrangement, to facilitate stability and "string clamps" at a point on the opposite side of the intonation point or second critical point on each of the bridge elements relative to the nut in order to limit string stretch to the prime vibratory portion of the string within these two points defining the scale length.

Knife Edge Pivots for the Fulcrum Tremolo

Rose (U.S. Pat. No. 4,171,661) shows adopting a novel shaped beveled edge to the base plate, called a "knife edge", adjustably supported by two screw-like members, referred to generally as riser posts, positioned in the body to collectively improve the return to initial position after pivoting the fulcrum tremolo device. The knife edge fulcrum pivot arrangement provides for the base plate to be positioned generally parallel to the instrument body, often referred to as a "floating tremolo", for example, and offered the novel possibility to substantively increase the tension of the string for upward pitch changes by rocking the base plate "rearward towards the body" with the arm. The inclusion of iterations of Fender '146, herein referred to as Type I, to include, similar to Rose, a knife-edge design on the leading edge, closest to the nut, of the base plate with a riser post arrangement adjustably connected to the fulcrum tremolo, herein referred to as Type II.

These two vintage fulcrum tremolos of the last century, Fender in the 50's and Rose in the 70/80's, are in part distinguished by the differing standards for the placement of the riser posts, that receive each of the knife-edges to create a pivot axis, relative to both first critical point on the nut as well as the second critical point on the bridge element. Accordingly, there are differences in the body pocket but less so for the cutout that receives the biasing springs and the distance from the face of the spring block nearest the nut to the corresponding face of the tremolo pocket.

DETAILED BACKGROUND OF THE INVENTION

The Stopped Tremolo

It is also known that many musicians, despite having the requisite hardware on their stringed instrument to enable a "floating tremolo" setup, intentionally choose to "block" or "stop" the fulcrum tremolo from being tilted "rearward" in order to remove the potential for an unwanted increase in pitch of the strings. This condition or setup is commonly referred to as a "blocked tremolo" or "stopped tremolo"—accordingly, the stop is considered a "hard" stop when it completely prevents pivoting the tremolo in one direction when at initial position. Additionally, as a significant part of this setup, increasing the overall tension of the biasing element past the minimum force required to make initial contact with a "hard" stop at initial position, is required to compensate for the increases in force in the tension string during bending notes, etc. meeting at least three objectives: 1) when a string breaks, the tremolo stop will ensure initial position, so that tremolo does not tip rearward and the rest of the strings do not go up in pitch, despite the missing counter balancing force of the un-tensioned or broken string, 2) ensuring the tremolo returns to initial position after radical use no matter what—to eliminate, among other things indigenous to the floating tremolo, the maintenance and care of initial position over time defined by the delicate balance of the forces and related wear and tear over time and 3) to make the tremolo less likely to be activated unintentionally compared to a floating tremolo, useful in general, for strumming, and makes double stops much more accessible when the force of the biasing element is increased. Tremolo stops of this nature have been created by small pieces of wood, plastic, etc. approximately 0.125"~0.250 or so thick which have been placed in the tremolo pocket between the spring block and the face of the tremolo pocket closest to the nut—even in "emergency" situations, a stack of guitar picks taped to the inertia block's face closest to the nut, in sufficient dimensions, can used for an evening, if need be.

Further, stopping a floating tremolo is common to meet the demands of auxiliary tension adjustment mechanisms: U.S. Pat. No. 5,359,144 ("'144") 10/94 to Robert Benson. Commercialized as the "D-tuna" mechanism for the "double-locking" Floyd Rose tremolos, the mechanism is designed to quickly re-tension the $6^{th}$ string from standard "E" down a whole step to "D" for "drop-tunings", i.e., instances where the pitch of at least one string is varied compared to standard tuning—the dynamics of the forces of tension between the strings and springs require, for optimal usage, a stopped tremolo:

- A pitch changing apparatus, providing bi-stable operation within a tremolo system which produces two distinct pitches for selected strings . . .
- In the Abstract:
- The tension correcting mechanism is manually rotated to adjustable stop positions of required spring counter-tension, thereby keeping all strings in tune under conditions of changed total string tension.

Van Halen: (http://www.dtuna.com/faq.php):

Why do the other strings go out of tune when I drop to D?

The bridge must be stabilized first. This is done by blocking the bridge so it cannot pull up. If your bridge is stabilized and the other strings are still going out of tune, you may need to increase the overall "spring tension" by moving the spring claw further from the block.

Accordingly, it is recommended by Van Halen that the "D-Tuna" device of '144 works better with an additional element or mechanism that will provide a "hard" stop the tremolo when the $6^{th}$ string is tuned to "D", the lower of the two target pitches; and, in order to ensure initial position of the fulcrum tremolo at the higher target pitch, since a hard stop requires increasing the overall force of the biasing element sufficient to compensate for the small increase in force, which unaddressed would yield a forward tilt otherwise present at the higher-tensioned "E" target pitch.

Floating Tremolo and Tremolo Stabilizers

One disadvantage, for some players, is that a "hard" stop eliminates the original capacity for light tremolo wavering effects around initial position and upward pitch bends. Accordingly, many players today would prefer a setup that acts like a fixed bridge for small force changes like bending strings, strumming at initial position yet "gives" and acts like a floating tremolo for using the tremolo arm for larger modern, pitch changes, such as "dive bombs", as is distinguished as a "soft" stop or tremolo stabilizer. As is known, the biasing element or spring system, provides a continuous generally linear force curve to establish equilibrium at initial position, but is not capable of changing its rate of tension, in general, stretching gradually and gradually as more force is applied.

Various mechanisms have been presented to assist the traditional biasing springs of Fender '146 in view of modern demands, such as the Hipshot branded "Tremsetter", Borisoff et al, U.S. Pat. No. 4,928,564 ("'564"). The Tremsetter device secured directly to the body's spring pocket, provides an adjustable pre-tensioned compression spring element added to complement the traditional biasing element to provide a discontinuous force curve exerted on the tremolo in order to provide an adjustable "soft" stop or tremolo stabilizer—the spring arrangement operable to increase the force required to pivot the fulcrum tremolo from initial position; its operability primarily to more firmly maintain the initial position of the floating tremolo compared to usage with an unassisted biasing element. Accordingly, when a force is exerted to move the tremolo out of initial position, that same tremolo is subject to a restoring force that is being borne by the stabilizing device limited enough in its range so that the compression spring element is active until the pre-tensioned restoring force is overcome during operation of the tremolo.

The Hipshot device and multi-spring variations like it, the Ibanez BackStop, the WD Tremolo Stabilizer, the ESP Arming Adjuster, the Goeldo BackBox, not all of which are available in the US at this time, none-the-less all comprise a compression spring-like arrangement deployed to complement the traditional biasing element, each secured to the tremolo spring pocket, tensioned upon installation to an approximate force of 8~10 pounds, capable of making variable contact with the spring block and urging the spring block in a direction away from the nut—these devices do not pivot with the tremolo about its axis—it requires approximately 4 pounds of force to "bend" a typical electric guitar unwound string a whole tone up in pitch under typical situations, 8 pounds or so of force will reinforce or ensure initial position under the conditions where two strings are bent.

Each such device employs a tensioned compression spring that seeks to stabilize initial position with an adjustable "soft" stop, to avoid the limitations of a 'hard" stop and to offer more stability in the instance of double stops which are otherwise more difficult:

A method of stabilizing a neutral position of a tremolo system including a pivoted bridge assembly including the steps of tensioning all of the strings of a guitar to a selected pitch slightly less than a desired pitch, tensioning certain counter-balance springs connected between said bridge assembly and the guitar body to oppose the string tension, and mechanically adjusting a certain counter-balance spring to bring the tension in the guitar strings to a desired pitch whereby said mechanical adjustment provides a mechanical stop for returning all of the guitar strings to a selected pre-tuned pitch.

Numerous other complementary mechanisms are secured to the tremolo spring pocket to enforce the position of the spring block such as Hirayama U.S. Pat. Nos. 6,552,252 and 6,686,524 for Ibanez include auxiliary springs to enforce initial position. Geier U.S. Pat. No. 7,427,703 commercialized as the "Tremol-no" releasable tremolo stop is also secured to the tremolo spring pocket in the body:

A quick-release tremolo lock device for installation into a tremolo recess, and for mounting to a movable bridge or a tremolo block of a stringed instrument such as a guitar. The tremolo lock device includes a spring mount that is adapted to be fixedly attached to at least one wall of the tremolo recess and configured to capture an end of at least one tremolo spring. A slide key is also incorporated into the device, which is connected to the spring mount about a proximate portion of the slide key. The device also includes an adjustable quick release slide receiver that is adapted to receive and to releasably capture a distal portion of the slide key to fix the position of the receiver relative to the slide key. The device further includes a tail piece joined to the quick release slide receiver and configured to be mounted in a spring hole of the tremolo block.

Lavineway U.S. Pat. No. 7,189,900 is provides a tension bar connected to the body operable on the spring block to ensure initial position:

A tension bar is held against the back of a lower portion of the tone block by at least one tension bar spring when the tone block is in a neutral position. Stopping means are provided to prevent the tension bar from urging the tone block forward of the neutral position.

The Mag-Lok from Super-Vee Tremolos, secured to the spring pocket, US patent pending, is a magnet-based alternative to the compression spring arrangement to ensure the tremolo in initial position during double stop bends and the like that is overcome when the bar is used.

Smith U.S. Pat. No. 9,029,671 provides for a device secured to the "upper surface of the body" adjustably connected to the tremolo base plate operable to selectively stop a floating tremolo:

A tremolo lock as provided preferably to allow the operator to engage the lock or stop from the topside of a guitar and tremolo base plate completing a floating double locking tremolo system preferably for electric guitars.

The Hipshot Tremsetter is also known to be installed with the D-tuna in order to improve the accuracy of the predetermined target pitches for a floating tremolo. Dam's U.S. Pat. No. 7,053,287, also secured to the body's spring pocket, for a similar device secured to the spring pocket for creating a soft stop include:

A compensator for a tremolo for a stringed musical instrument, such as an electric guitar. The compensator has an integrated tremolo stop, allowing a musician to continue playing without undue delay in the event a string breaks.

Further,

The object of the present invention is to provide a compensator having an integrated tremolo stop which allows the musician to resume playing with a minimum of delay after string breakage, and to provide ready access to the tremolo stop while keeping the number and size of the openings as small as possible.

Didan U.S. Pat. No. 6,943,284 September 2005 for a retractable tremolo stop mechanism comprising a retractable cam adjustably secured to the top body surface bracketed between the spring block and the base plate:

. . . having a first inoperative position and a second operative position in which it stabilizes the bridge plate by limiting movement of the bridge plate in one direction in response to the spring means, means for maintaining said cam in said first position and said second position comprising of a frictional restraint in contact with said cam, method for establishing the normal position of the bridge, The cam is selectively operable by the player between an inoperative (retracted) position, and an operative position in which it serves to stabilize the bridge plate.

The cam is pre-set with a limit stop whereby its actuation stabilizes the bridge plate at a position providing for normal tune of the remaining strings despite the failure of any one or more strings, or for purposes of tuning the instrument.

Rose U.S. Pat. No. 8,946,529, February 2013, apparatus includes a modification of his fulcrum tremolo for top mounted Gibson-style applications to include a re-enforcing element for initial position—this design obviates the traditional spring block that pivots within the body of the instrument and the biasing element arrangement:

The apparatus includes a mounting frame configured for mounting on the surface of the body of the instrument, an attachment post secured to the body, a base plate pivotally mounted with respect to the attachment post and having a surface adapted to receive a force, a mounting assembly mounted on the base plate for holding a string of the instrument, and a first resilient member assembly for engagement with the mounting frame outside the body of the instrument and supplying a stabilizing force to the base plate against a tension force in the string. The apparatus includes a second resilient member assembly configured to be engaged with the mounting frame outside the body of the instrument and to supply a force to the base plate surface adapted to receive the force.

As discussed above all of the various compression spring based mechanisms described above are secured to the body, in the spring pocket, in particular, and, accordingly, do not rotate with the tremolo at any time, to make variable unsecured contact with the spring block to apply an expanding force supplied by compression springs against the spring block in a direction way from the nut to augment the linear force applied by the biasing element pulling in the direction towards the nut. In each case the adjustment members are very small, often positioned between the individual springs of the biasing element and difficult to adjust initially and to compensate for changes over time.

The Global Tuner invention offers a quick way to adjust the dynamic relationship between tensioning forces between the strings and springs with a thumbwheel to maintain "initial position" over time. The typical Global Tuner splits the tremolo's inertia or spring block into two sections transverse the direction of the counter springs. One section is a base element or main block that is connected to the tremolo base plate and the other section comprises a holder element connected to the biasing element or counter springs, in a format that is connected to the main block and which is, in either case, adjusted by a thumbwheel arrangement. (See Advanced Global Tuner—U.S. patent application Ser. No. 14/687,776 Apr. 28, 2015). Since acoustic coupling is best in the instance of the greatest contact between the associated parts, when the spring holder element is slideably positioned within, say, 0.031" of the base element, a first position, when the assembled parts have the greatest contact area to each other. Threading the thumbwheel to variably position the holder element in either direction will restore initial position under normal conditions while maintaining the best coupling for this design.

The Global Tuner provides a variable adjustment mechanism invention that neither meets the requirements to achieve a stopped initial position nor a "soft" stopped initial position—the need for a stable and adjustable tremolo stop tuner is clear.

SUMMARY OF THE INVENTION

The Tremolo Spring and Stabilizer Tuners

Tremolo Spring

Tremolo Spring includes a formed flat spring element featuring a flexible bend operable to exert a first variable force of tension against the body, the flexible bend transverse the direction of the strings and generally parallel to the tremolo axis, the first variable force of tension essentially equal to the force of tension provided by the strings to establish the fulcrum tremolo at initial position.

The formed flat spring element having generally planar surfaces forming opposing faces, further including a first upper leg secured to the tremolo and a first lower leg forming a generally longer lever-like portion, generally 1.125~1.75" in length, approximately 2.0" wide extending towards the body. The strings tensioned for play, at least a portion of a first face of the longer lever-like lower leg operable to make first variable contact with the body to achieve initial position and variably support the pivoting of tremolo.

The end of lower leg can further comprise a second bend forming a first face curved surface to facilitate first variable contact with the body or other such provision. In one embodiment, the profile of the formed flat spring element is generally an L-shape where the shorter leg is secured to the tremolo. In this application, the width, length and material thickness are all inter-related parameters. All things being equal, the variable force of tension created by the flexible bend depends greatly from how thick the material is, the formed flat spring is has a 1~2 mm material thickness for establishing a first variable force of tension. A thinner strip of flat spring, say 0.25~1 mm, can be used for the second variable force of tension, for example.

In another expression, the a combination spring comprising more than one formed flat spring element, taking a L-shaped form, with unequal lower leg lengths. In this instance a first flat spring element shorter length leaf (first lower leg) would comprise at least the major portion of the first variable force of tension and a second flat spring element longer thinner leaf (second lower leg) would comprise at least the second variable force of tension to provide for the first and second variable force of tension.

Tremolo Spring Tuner

A novel Tremolo Spring Tuner offers an adjustment of the first flat spring first variable force of tension; the global adjustment of the first variable force of tension can be accomplished in at least one of two ways in this current application. In one instance, 1) a mechanism varies the position of end of lower leg in a first variable contact with the body, or other such mechanism, to vary the force of the flexible bend, for example, and 2) a variable connecting element, such as a setscrew, contacting the lower leg near the lower surface of the base plate, making an alternative or second variable contact, to limit the first variable force of the first flexible bend. In the later case, the first variable force of tension can be greater than string tension so that the adjustment element can reduce the force to meet the string tension to establish initial position.

For the first approach, Tremolo Spring Tuner including a base element secured to the instrument, a first adjustment screw, the first adjustment screw in the direction of the strings, the base element rotatably supporting the first adjustment screw, a spring tensioner element transverse the direction of the strings is operable to receive the end of the first adjustment screw, the string tensioner element variably secured to the base element, having a spring side surface generally parallel with the first face of the flat spring, the spring side surface further operable to make first variable contact with the outer first face planar surface of the curved second bend. The tensioner element is pivotally connected to the base element by a pin in a direction transverse to the direction of the strings. Threading the first adjustment screw variably adjusts the spring face surface, and thereby, the first face of the curved bend to vary the first flexible bend, to increase or decease the first variable force of tension to achieve initial position. The adjustment screw comprising a global tuner thumbwheel to facilitate adjusting the tensioner element.

Alternatively, Tremolo Spring Tuner further comprising a second curved flat spring operable to hold a second variable force of tension and a global tuner comprising a thumbwheel, the thumbwheel shaft further comprising a tensioner element forming a cylindrical cam-like portion operative to variably adjust an end of the second curved flat spring as the thumbwheel is turned, wherein the curved section of the second curved flat spring making second variable contact with the inner second face of the first flat spring closer the flexible bend than the end of the lower leg to limit the first variable force of tension; the tensioner element to variably adjust the first variable force of tension.

A simple Tremolo Spring Tuner is presented including the base element secured to the instrument, a set screw threadedly secured through the base element, the setscrew in the direction of the strings, the set screw operable to form a second limited contact area with a second face of the generally planar lever-like lower leg in a position generally closer to the base plate than the curved second bend. Threading the setscrew to further contact the lower leg is operable to limit at least a portion of the flexible bend to vary the variable force of tension.

Stabilizers

The Stabilizer includes either a formed flat spring or a pre-loaded coil spring element comprising at least a portion of a flexible bend operable to hold a variable force of tension including a second force of tension, the second force of tension less than the tension provided by the strings, to enforce initial position. The Tremolo Stabilizer includes a thumbwheel arrangement to variably adjust the position of an independent stabilizer arrangement.

In one embodiment, the formed flat spring comprising at least one L-shaped flat spring, with a short upper leg connected to the spring block and/or the base plate and a longer lower leg extending to the body operable to exert the first variable force of tension at initial position. The Stabilizer Tuner arrangement provides a screw-like element that extends from a mounting arrangement in the body to make variable contact with the inner face of the L-shaped flat spring. Further, adjusting the spring claw screws in the spring pocket for adjusting the first variable force of tension will inter-cooperate with the variable force of tension that the flexible bend of L-shaped spring steel-like plate applied to the face of the tremolo pocket to reinforce initial position for strumming and light tremolo action.

Another embodiment of the tremolo stabilizer comprises a formed flat spring steel clip-like element secured to the extended portion of the spring holder arrangement to make initial contact with the tremolo pocket face at initial position, the form comprising a bend operable to hold a second variable force of tension. This arrangement reassigns the thumbwheel adjustment member of the Tremolo Stop Tuner to instead variably position the formed flat spring arrangement relative to the inner face of the tremolo pocket. The setscrew arrangement fixes the position of the thumbwheel and couple the device to the instrument. Alternately, say, a removable 2 mm thick foam rubber strip, or such with sufficient elasticity could be positioned on the extended portion operable to comprise a force sufficient to reinforce initial position for stabilized strumming, etc. A first embodiment of the Tremolo Stabilizer comprising primarily an adjustment member or, alternately, a thumbwheel, threadedly connected through the spring block of a fulcrum tremolo, and moveable therewith around the tremolo pivot axis, the adjustment member extending in the direction of the strings. The adjustment member, threadely or pivotally, adjustably connected to the spring block, the adjustment element operable to make initial contact with the tremolo pocket to limit pivoting in one direction from initial position. In another alternative embodiment, the adjustment member or a thumbwheel element includes a holder element, including an extended portion, separate from the spring block base element operable to be adjusted towards the tremolo pocket face and away from the base element to make initial contact. A set screw, threadedly positioned in the base element and in variable contact with the thumbwheel adjustment mechanism, is threaded in a first direction to fix the position of the extended portion at initial contact to form a stop to impede rotational movement in one direction at and from initial position.

Further the extended portion, and moveable therewith, can support a "soft" stop or tremolo stabilizer arrangement comprising, for example, compression spring arrangements including the use of flat spring plates in various shapes, sizes, etc. to complement the first variable force of tension at initial position.

Stabilizer Tuners

As above threading the thumbwheel adjustment mechanism is operable to adjust the holder element comprising the flat spring stabilizer to vary the second force of tension.

In a preferred embodiment, an independently adjustable pre-loaded internal coil spring arrangement comprising a Tremolo Stabilizer is presented. The Tremolo Stabilizer comprising a cylindrical housing threadedly secured to the spring holder extended portion or alternatively to the main block. The most preferred arrangement having a housing, a washer and coil or wave spring at one end, a support collar or guide element variably positioned within the tensioner element and the formed openings in the extended portion, an adjustment pin or extension element threadely connected to the collar operable to variably extend the adjustment pin to the tremolo pocket. The adjustment pin comprises a rounded tip often and sometimes comprises a ball bearing element. The device includes the force of tension of the internal compression spring within the housing of the Tremolo Stabilizer to comprise an adjustable force of approximately 2~15 pounds. A player can adjust the pre-loaded condition of the coil spring by rotating the housing. Accordingly, the apparatus comprises a limited discontinuous force operable to increase the force required to pivot the fulcrum tremolo rearwardly from initial position. Since the adjustment by the tensioner element of the force of the internal compression spring is independent of the adjustment of the forces of the biasing element, the thumbwheel is free to be operable to re-establish initial position on the fly without altering the integrity of the finely adjusted pre-tensioned forces of the spring arrangement.

In yet another embodiment the internal pre-loaded coil spring arrangement can be modified to provide the first variable force of tension in order to obviate the traditional tremolo springs and spring claw arrangement.

"Initial position" refers to the position of the fulcrum tremolo and, therefore, the position of the second critical point on the bridge elements in relation to the first critical point on the nut such that the tension of the strings, each at the intended proper pitched condition, the spring block, and the appropriately tensioned counter springs, renders a specific equilibrium point wherein the harmonic tuning for all the strings is simultaneously achieved.

"Global Tuner" refers to an adjustment device added to a fulcrum tremolo and its associated counter spring or biasing element arrangement with the capacity to essentially re-establish the equilibrium point, created at the time of the initial setup by the tension of the counter spring(s) and the tension of the strings, in order to compensate for changes in tension requirements on the strings and/or the counter springs due to various factors. The Global Tuner preferably employs an adjustment knob or thumbwheel element for providing continuously variable adjustment of the tension in the strings by varying the relative distance between the spring attachment portion connected to the fulcrum tremolo and the attachment point of the springs to the body of the instrument. The Global Tuner thumbwheel portion provides a simple and quick means for the musician to adjust the initial position of the fulcrum tremolo in order to meet the pitch requirements in varied environmental or other situations and, in re-establishing the initial position, allows the full range of pivoting the fulcrum tremolo.

"Initial contact" refers to instance of an adjustment when a tuning mechanism first touches the instrument body, the tuning mechanism operable to affect initial position in a fulcrum tremolo.

A "hard" stop provides initial contact operable to impede rotation of the fulcrum tremolo in one direction at initial position; the "over-tightening" of the biasing element requirement to reinforce initial position obviates a global tuner.

"Tremolo Stop Tuner" refers to device integrated into a fulcrum tremolo spring block, moveable therewith about the tremolo pivot axis, comprising a holder element comprising an extended portion operable to either variably contact the body with the capacity to stop or block the tremolo at initial position, adjustably support a compression spring element to enforce initial position or global tune an independent stabilizer arrangement enforcing initial position.

A "soft" stop provides initial contact operable to affect a limited discontinuous force curve exerted on the tremolo spring block to adjustably impede rotation of the fulcrum tremolo in one direction at initial position. The adjustability obviates a stop mechanism.

"Initial condition" refers to the instance of an adjustment of the force operable at initial contact to complement the force of the biasing element when at initial position for a "soft" stop.

A "Tremolo Stabilizer" refers to a formed spring element arrangement added to the fulcrum tremolo, to make initial contact with the body with sufficient force of tension to limit the essentially linear performance of the biasing element force of tension in order to enforce initial position. Accordingly, when a force is exerted to move the tremolo out of initial position, the tremolo is subject to a restoring variable second force of tension that is borne and defined by the pre-tension stored in the spring element until the restoring force is overcome during deeper rotation or pivoting of the tremolo or disengaged at or near initial position.

Given sufficient focus of the discontinuous force at initial position to impede rearward tilt, the soft stop arrangement can be combined with an auxiliary quick pitch change apparatus, like the D-tuna, the Drop Tuner—McCabe U.S. patent application Ser. No. 14/880,271 ("'271") or any device with the capacity to quickly change from one adjustable predetermined pitch to another adjustable predetermined pitch and back to ensure the tremolo remains at initial position when the higher tensioned string is toggled to a lower tensioned condition.

The body further comprising a Global Tuner thumbwheel arrangement with a thumbwheel is shown rotatably connected to a mounting element secured to the body, the mounting element comprising a spring tensioner element, the spring tensioner element variably secured to the mounting element by a pin, the spring contact element comprising a spring face surface operable to make variable contact with L-shaped flat spring lower leg. In the preferred embodiment the spring tensioner element further comprises a recess to receive the tip of the shaft of the thumbwheel to variably adjust the lower leg; accordingly the thumbwheel adjustment member threading adjusts the position of a L-shaped flat spring second end to vary the first force of tension.

Also shown is a locking macro-tuner mechanism comprising an articulated extended tip of extended laver-clamp improvement to facilitate threading a string through the nose slot to pivot or lift the clamp lever for successful loading of the string from a direction opposite or distinct from the traditional direction of operation carried out from the direction the tailpiece portion securing the string to the instrument.

Figure 3:
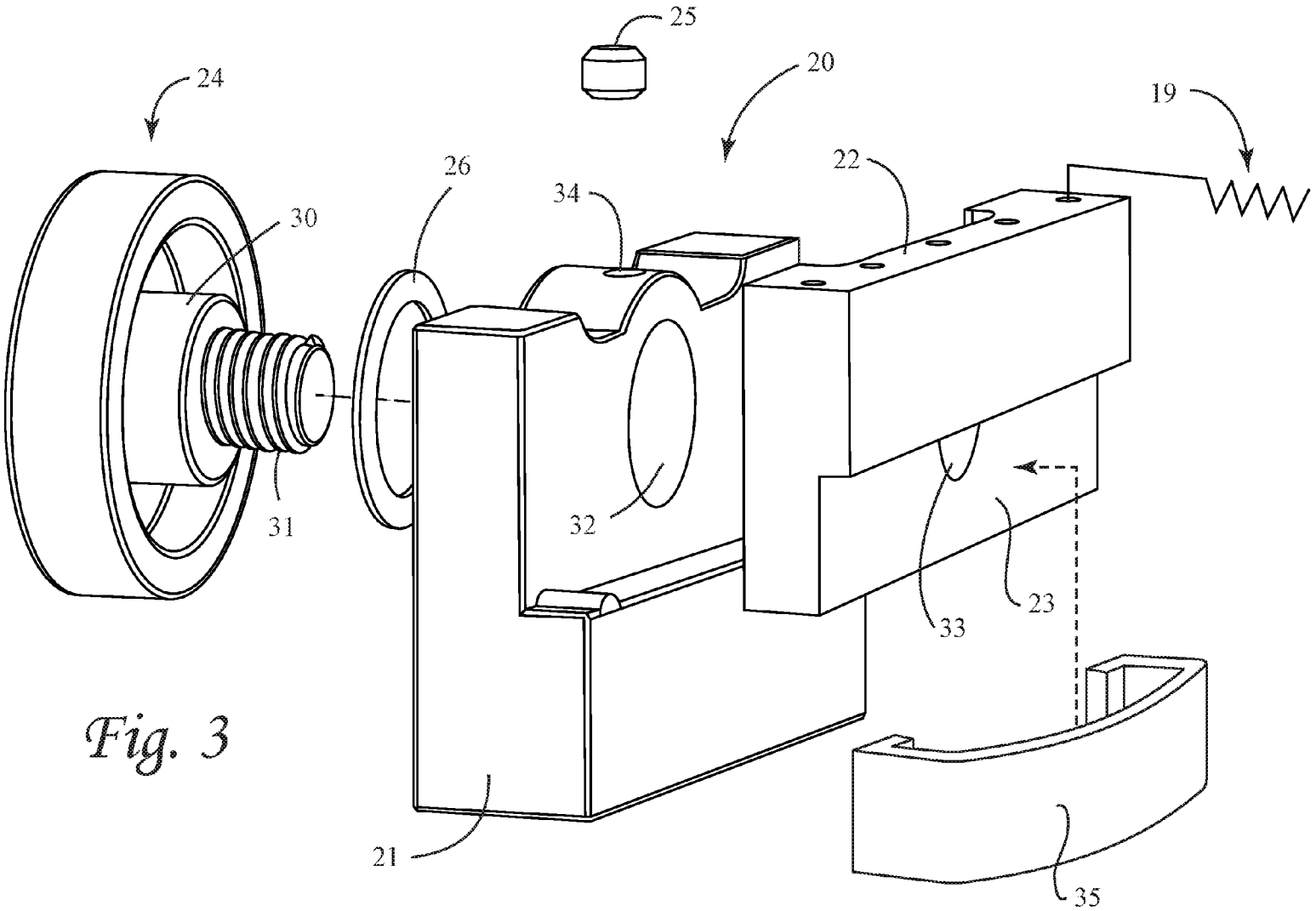

FIG. 3 is an exploded view of a first Tremolo Stabilizer embodiment configured by repurposing parts of and adding components to the Stop Tuner. A pre-tensioned compression spring-like element, supportedly positioned by the extended portion of the holder element in and between the base element and the tremolo pocket first face, is operable to exert a variable limited force at initial contact to enforce initial position. The compression spring-like element complements the biasing element to create a variable "soft" stop or Tremolo Stabilizer. Threading the adjustment element or thumbwheel in this setup is operable to variably adjust the rate of the force of the pre-tension in the context of the configuration's interdependence with force of the biasing element at initial position.

Figure 2:
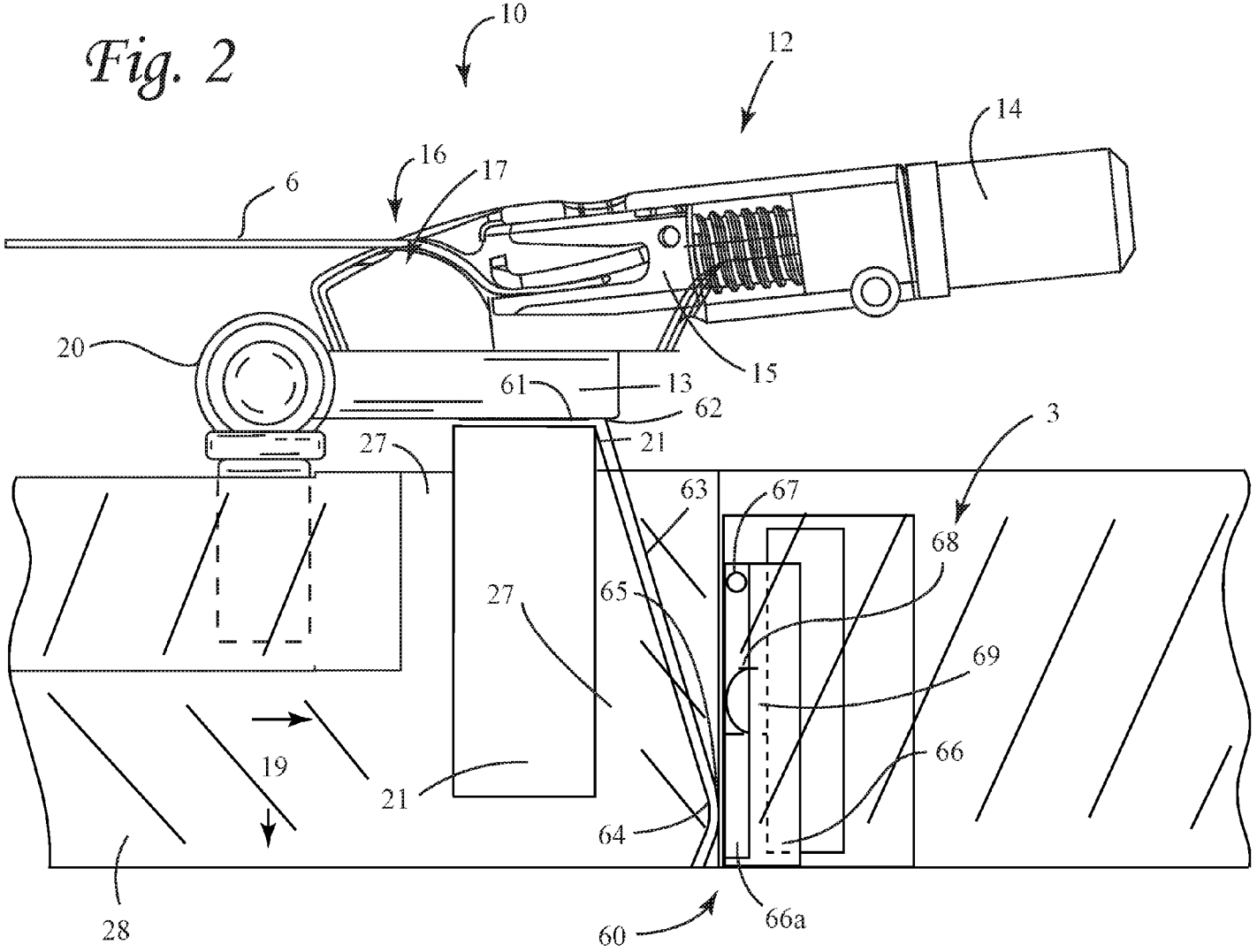
FIG. 2 is a side view of the tremolo showing the Tremolo Spring mechanism in profile comprising an L-shaped flat spring secured to the tremolo at an upper leg and a lower leg extending to make contact with the tremolo pocket, a flexible bend operable to hold a first force of tension to replace the traditional fulcrum tremolo coil spring biasing element arrangement. The L-shaped flat spring extends about 0.125" to 0.250", relative to the main inertia block, further comprising an extended portion having a generally planar surface, transverse the direction of the strings, the lower leg comprising a first face closer the spring block and a second face closer to the body, the first face operable to make variable contact with the body. In this depiction, the first face making contact with a first force of tension essentially equal to the string tension, thereby resisting the rotation of the tremolo from initial position in one direction.
Figure 4:
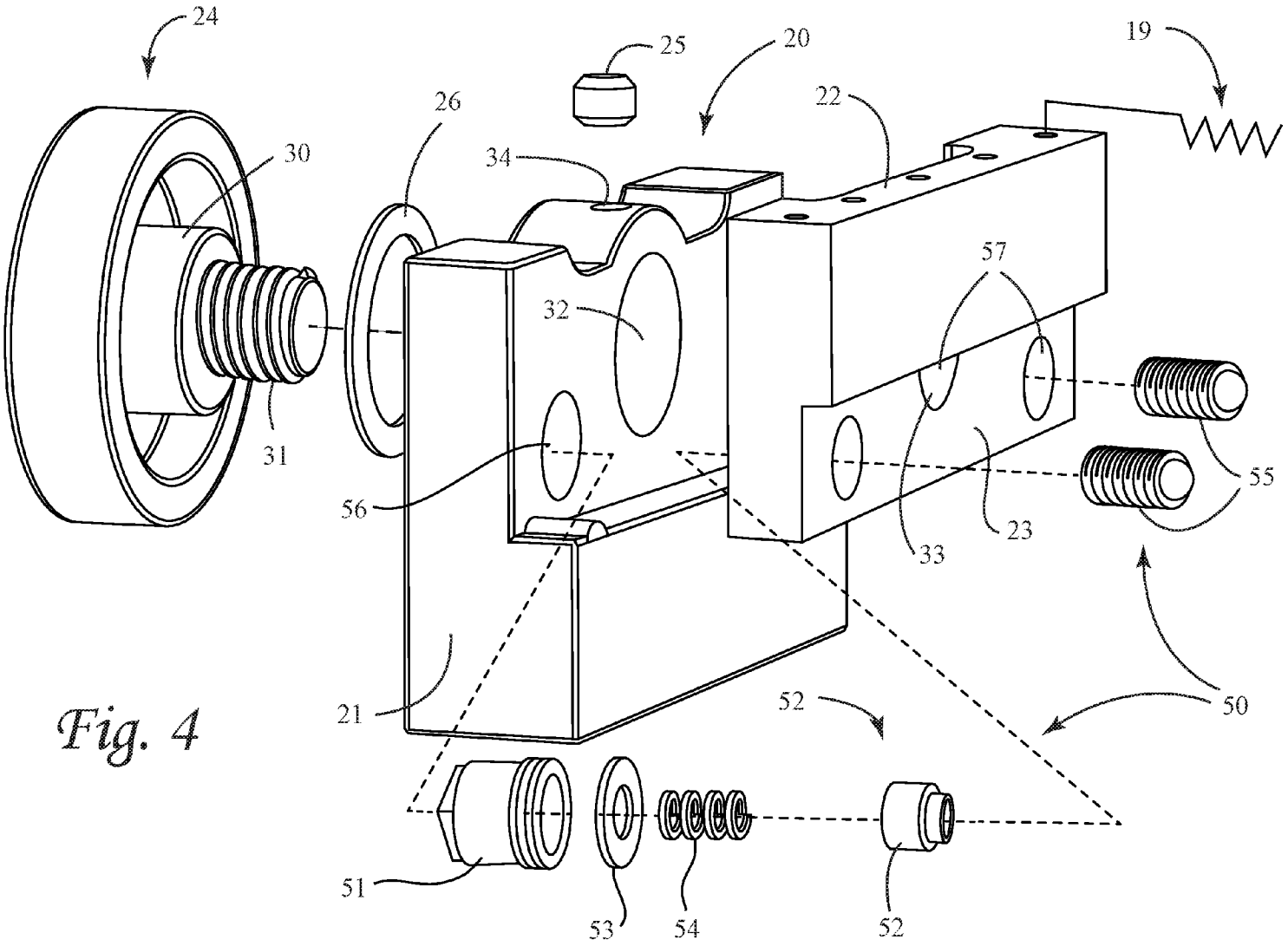

FIG. 4 shows a fully independent adjustable Tremolo Stabilizer, repurposing the stop aspect of the extended portion as seen in FIG. 2 to variably support and position a tensioner element including a guide element, a fine adjustment element or extension element, a pre-tensioned compression spring and washer; the tensioner element is threadedly connected to the extended portion, positioned additionally within cooperating cavities in the main spring block. The tensioner element formed to receive the washer, the compression spring and guide element, compression spring positioned between the guide element and the washer, threading the tensioner element adjusts the pre-tension of approximately 4 pounds, twin mechanisms (not shown) are used, one on each side of the center mounted thumbwheel adjustment element operable with sufficient force to variably enforce initial position. The fine adjustment element is theadedly secured within the guide element and operable to adjust the tip in dimensions up to more than 0.250 from the spring block to the first face for initial contact. Since threading the tensioner element is independently operable to variably adjust the rate of the force of the pre-tension, this configuration benefits from the increased stability and improved acoustic coupling set screw improvement and frees the thumbwheel element to global tune the stabilized initial position over time.

Figure 5:
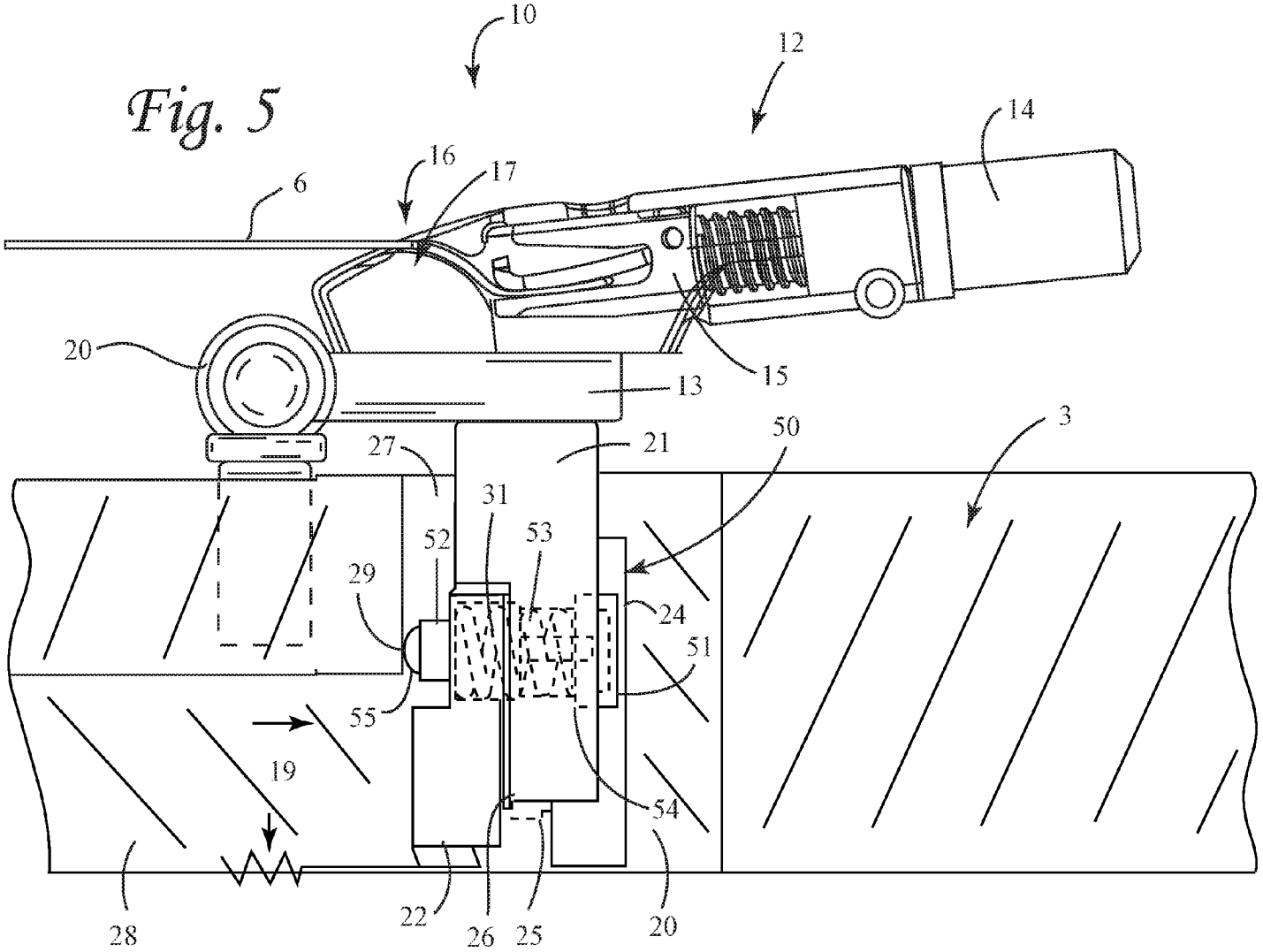
Figure 6:
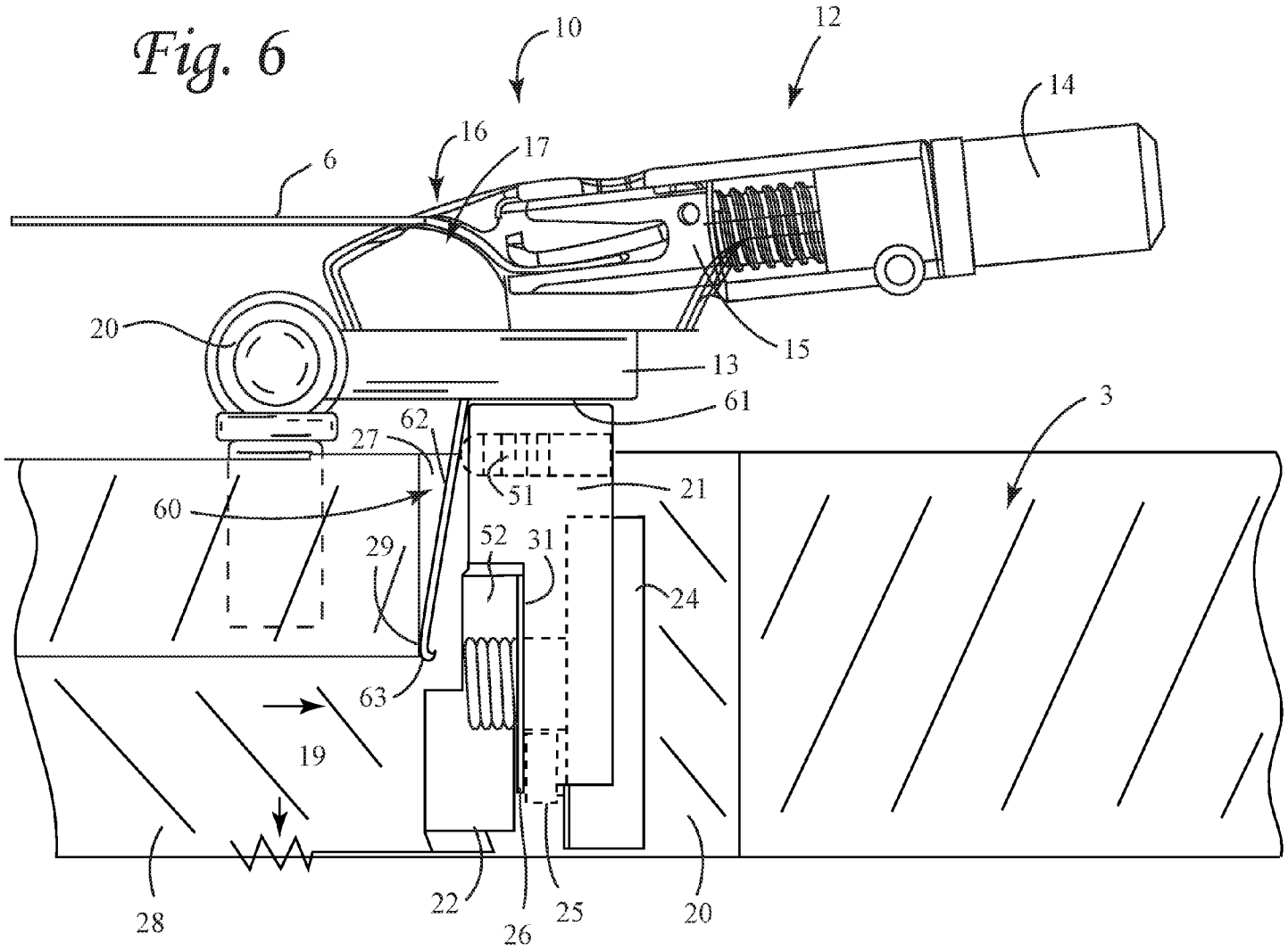

FIGS. 5 and 6 show two alternative Tremolo Stabilizer embodiments in profile where the thumbwheel function is also independent of the adjustment of the stabilizer.

FIG. 5 shows a profile view of the Tremolo Stabilizer improvement shown in FIG. 4 including its relative position in the tremolo pocket area at initial contact. The twin Stabilizers are collectively capable of exerting a combined force of at least 8 to 10 pounds to variably ensure initial position.

FIG. 6 shows an adjustable stop tuner configured for a setup with a global tuner wherein a further alternative example of a Tremolo Stabilizer comprises a single pre-tensioned L-shaped bent piece of sheet metal positioned between the tremolo base plate, and moveable therewith, with the short leg between the spring block element and the base plate and the longer leg extending with a mild curve at the tip for initial contact with the tremolo pocket as shown in FIG. 3. Pivoting the tremolo to flatten pitches engages the pre-tensioned L-shaped spring steel stabilizer mechanism to reinforce the initial position. A setscrew operable to variably contact the L-shaped long leg to modify the rate of the spring is presented. Further, the biasing element can be adjusted.

Figure 7:
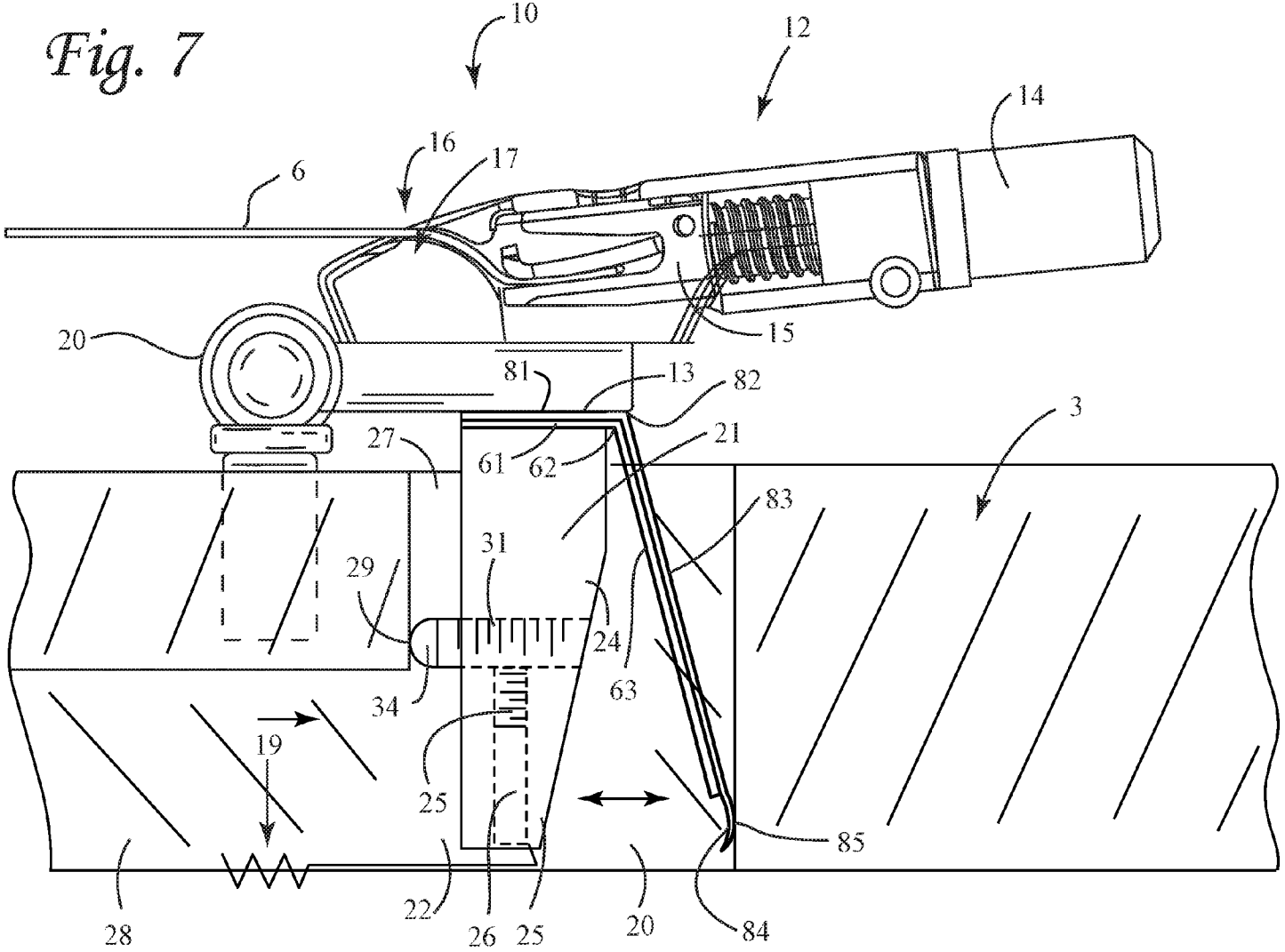
Figure 8:
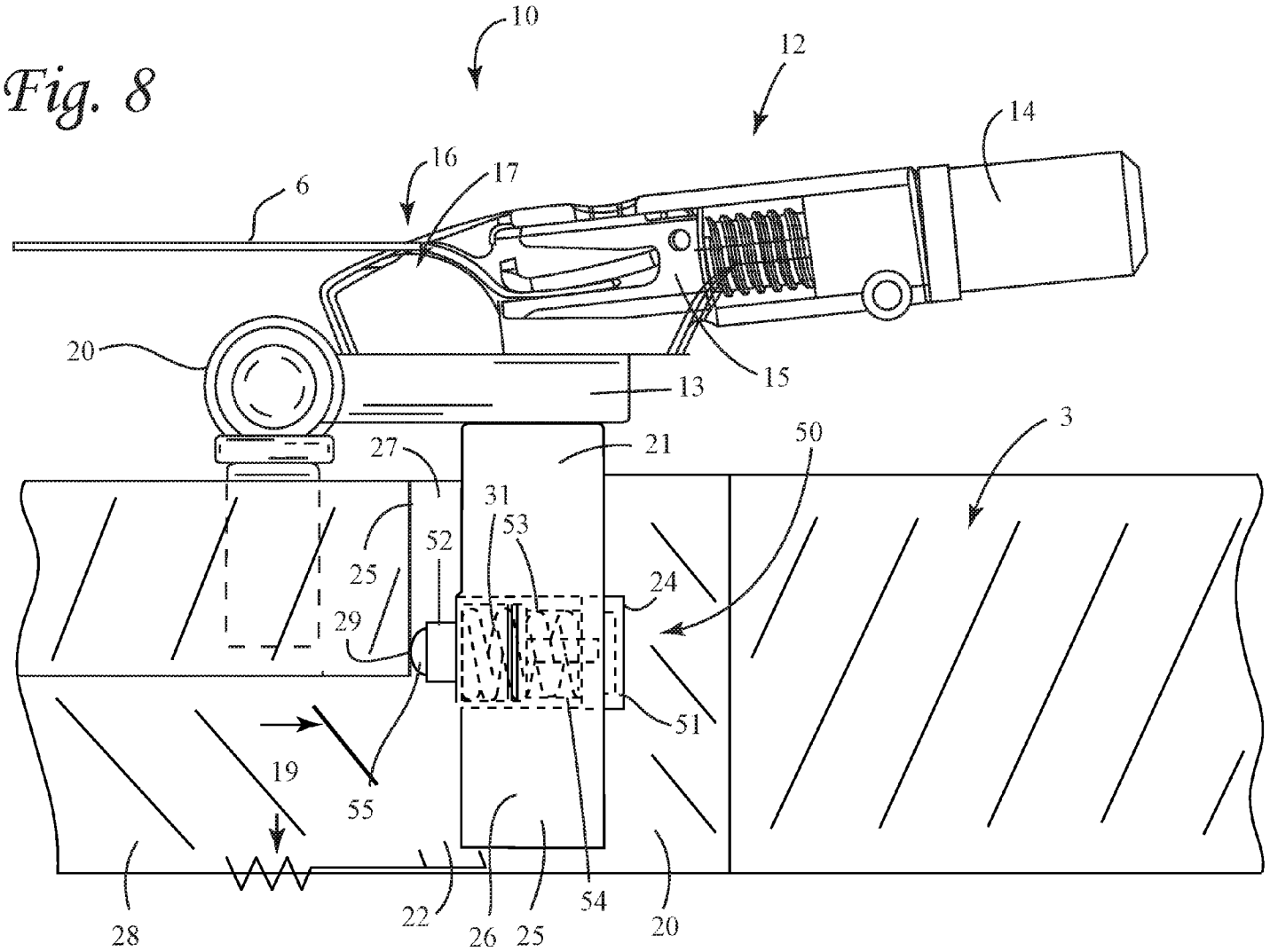

FIGS. 7 and 8 show two primary fundamental embodiments each notable for not employing an extended portion or thumbwheel.

FIG. 7 comprises another profile view showing the traditional spring block further comprising, and thereby moveable therewith, an adjustment element and setscrew arrangement, each threadedly engaged with the spring block. The adjustment element is threaded within the spring block to make initial contact with the instrument body to "stop" a tremolo; the setscrew secures the position and improves coupling between the three parts. Further, a compound flat spring biasing element formed by two L-shaped flat springs of unequal lengths and varied material thicknesses for the lower legs, like half of a "leaf spring" cut in the middle. A thicker first lower leg comprising at least the major portion of the first variable force of tension and the longer thinner leaf would complete the first variable force of tension requirement and provide for the second variable force of tension. The Stop Tuner, establishing a range for the rearward pivot/upward pitch change, and the compound flat spring arrangement comprising a stabilized biasing element.

FIG. 8 also shows in profile the tremolo device with single adjustable Tremolo Stabilizer added to a similar traditional spring block arrangement. The tensioner is operable to vary the force of the coil spring pre-load and the contact pin is operable to adjust to variations in varied tremolo pocket dimensions to make initial contact at initial position.

Figure 9:
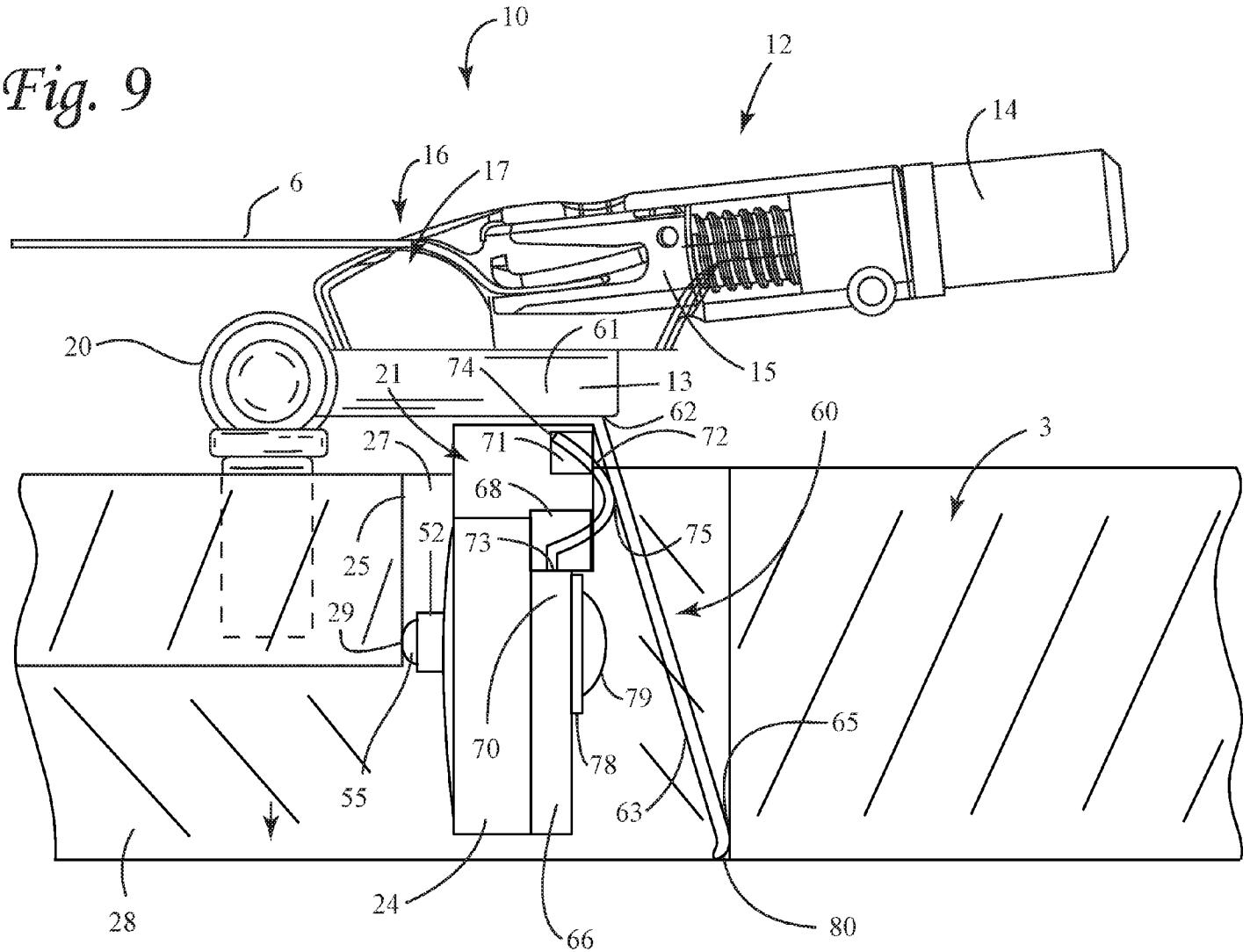

FIG. 9 shows in profile the tremolo device with single adjustable Tremolo Stabilizer added to a similar traditional spring block arrangement more profoundly presented in FIGS. 4 and 5. An L-shaped spring flexible bend includes a lower leg including a curved portion extending to variably meet the body operable to hold a first variable force of tension at initial position. The Stabilizer Tensioner is operable to adjust the second force of tension, the coil spring pre-load and the contact pin operable to adjust to variations in varied tremolo pocket dimensions to make initial contact at initial position. A global tuner arrangement is shown with a global tuner thumbwheel extending through the base element to provide a cam-like surface operable to contact and variable position one end of a tensioner spring within a first recess. The tensioner spring having a flexible curved portion pivotably connected to a second recess in the base element in a recess. At least a portion of the flexible curved portion operable to contact the first L-shaped spring at a contact point closer to the flexible bend than to the tip.

DETAILED DESCRIPTION OF THE INVENTION

Figure 1:
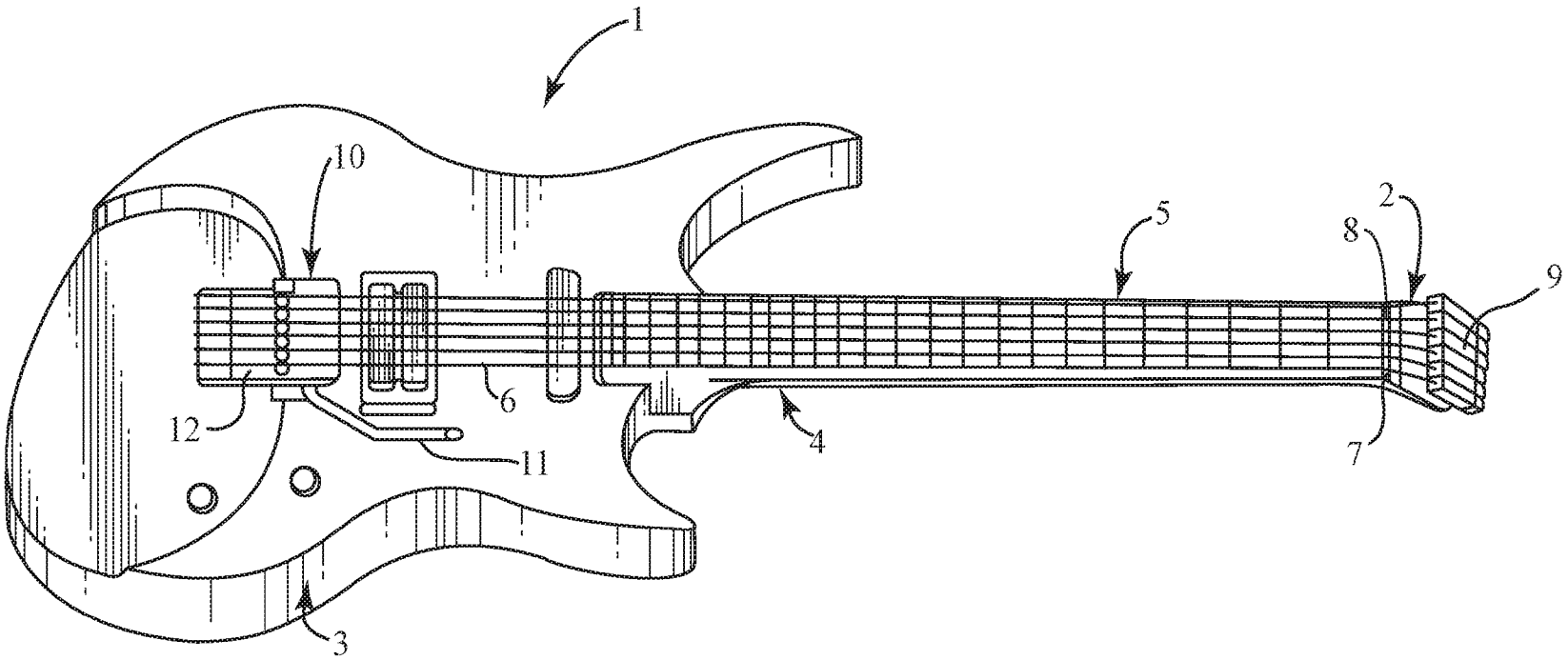
FIG. 1 is a plan view of an electric guitar embodying the present inventions.

In FIG. 1, an electric guitar 1 is illustrated comprising head 2 at one end, a body 3 at the other end, with neck 4 extending between head 2 and body 3. Six of each string 6 extends from head 2 to body 3 over neck 4. Neck 4 forms fret board or fingerboard 5 for guitar 1. At head 2, each string 6 extends over nut 7 forming first critical point 8 for each string 6. Nut 7 is located at the transition of neck 4 to head 2. Each string 6 is secured on head 2 by a corresponding element 9. On body 3, strings 6 are secured to fulcrum tremolo 10. Fulcrum tremolo 10 has arm 11 for pivoting tremolo 10 to provide the vibrato effect on the strings. Fulcrum tremolo 10 has six intonation modules 12, one for each string 6. By manipulating tremolo arm 11, the entire fulcrum tremolo 10, not including the riser posts and inserts (and in varied designs, related bearing assembly elements), can be pivoted to achieve the desired tremolo effect.

Intonation module 12, shown as a macro-tuner, incorporating the function of bridge or saddle and tailpiece elements, is provided to support string 6. Intonation module 12 is slideably adjustable on base plate 13 to adjust the relative distance between first critical point 8 and second critical point 16 (FIG. 2) to intonate the associated string. Fulcrum tremolo 10 comprises a second critical point 16, one for each string 6, sometimes characterized as an intonation point, witness point or bridge point.

The invention is shown for on electric guitar 1 with six strings 6 and it should be understood that the invention could be used on a variety of stringed musical instruments. In body 3 of guitar 1 there are electric pickups shown without numbers. In the following description, fulcrum tremolo 10 will be described in greater detail.

FIG. 2 displays fulcrum tremolo 10 at initial position in a partial cross-section side view showing body 3. Electric guitar 1 further comprising tremolo pocket 28 and tremolo spring pocket 29, Tremolo Tuner 60 and locking macro-tuner 12 comprising bridge element 17, an associated tailpiece comprising tuning pin 15 variably positioned by tuner knob 14 to alter the tension of string 6 secured to head 2 (not shown). Second critical point 16 is located on intonation module 12. String contact point 16 on bridge element 17. The leading-edge portion of base plate 13 adjustably supports tremolo 10 pivotally relative to body 3. Spring block 21, connected on one end to base plate 13.

Tremolo 10 comprising L-shaped flat spring upper leg 61, secured between base plate 13 and base element 21, L-shaped flat spring upper leg 61 further forming flexible bend 62 and a lower leg 63 comprising curved contact bend 64 operable to make variable contact with spring block 21 forming first contact area 65. Tremolo Spring 60, in a novel position within the traditional tremolo pocket arrangement, having a generally planar surface, approximately 90° to the direction of the strings, curved contact bend 64 operable to variably contact the generally planar parallel surface of inner tremolo cavity forming area 65, flexible bend 62 operable to exert the first variable force of tension against body 3 at initial position. In this depiction, second end extension 64 functioning as a variable fulcrum tremolo biasing element, curved contact bend 64 at contact area 65 exerting a first force of tension essentially equal to the string tension, thereby resisting the rotation of fulcrum tremolo 10 from initial position in one direction.

Tremolo Spring 60 further comprising a global tuner arrangement, in a further preferred embodiment, comprising mounting element 66 secured to body 3 as well as spring tensioner element **66*a* and thumbwheel 24, thumbwheel 24 comprising a global tuner thumbwheel. Mounting element 66 formed to rotatably support thumbwheel adjustment member 24, thumbwheel adjustment member 24 end 69 in bearing contact with spring tensioner element 66*a* recess 68, spring tensionerelement 66*a* variably secured to mounting element 66 by a pin 67, spring tensioner element 66*a* operable to make variable contact with L-shaped flat spring second end extension 63 curved contact bend 64 comprising contact area 65. In the preferred embodiment, threading thumbwheel adjustment member 24 to variably position spring tensioner element 66*a* and, thereby, second end extension 63, adjusts the variable first force of tension provided by flexible bend 62**.

Also shown is a locking macro-tuner mechanism 12 comprising an articulated extended tip of extended laver-clamp tailpiece improvement 15 to facilitate threading string 6 through the nose slot to clamp string 6 as an alternative to tailpiece tuner knob 14, from a direction opposite or distinct from the traditional direction of operation carried out from the direction the tailpiece portion securing string 6 to body 3.

FIG. 3 illustrates an exploded view including main block 21 connected to base plate 13, holder element 22 with extended portion 23 and thumbwheel element 24. Biasing element 19 is shown connected to holder element 22. Thumbwheel element 24 threaded portion 31 and smooth portion 30 passes through transverse opening 32 to engage threaded opening 33 in holder element 22 to position extended portion 23. A bendable flat spring element 35 secured to extended portion 23, compressed between extended portion 23 and tremolo pocket contact area 29 (not shown) at initial position, to provide a second variable force of tension applied to the body when the tremolo is tilted rearwardly to comprise "soft" stop or Tremolo Stabilizer 20. Setscrew 25 is tightened to fix the position of extended portion 23.

FIG. 4 shows alternate improved Tremolo Stabilizer 50, adapted to extended portion 23 of spring holder 22, further comprising tensioner housing 51, guide element 52, fine adjustment element 55 extending through pre-loaded (in assembly) coil spring 53 and washer 54, adjustably positioned within extended portion 23 cooperating cavity 56 and cooperating spring block 21 cavity 57.

Two stabilizer mechanism 50, holding a second variable force of tension collectively, at least 8~10 pounds force, the second force of tension less than the first force of tension, fine adjustment element 55 positioned to make initial contact with tremolo pocket contact area 29, tremolo 10 at initial position. Tremolo Stabilizer 50 pre-loaded coil spring 53 biasing element 19 first variable force of tension to increase the force required to pivot fulcrum tremolo 10 from initial position in rearwardly.

FIG. 5 shows a profile view of fulcrum tremolo 10 in a partial cross-section side view showing body 3 further comprising tremolo pocket 28 and tremolo spring pocket 29, Tremolo Stabilizer 50 and locking macro-tuner 12 comprising bridge element 17, an associated tailpiece comprising tuning pin 15 variably positioned by the tuner knob to alter the tension of string 6 secured to head 2 (not shown). Second critical point 16 is located on intonation module 12. Base plate 13 pivotally support tremolo 10 on body 3. String contact point 16 on bridge element 17. Base element 21 connected to the base plate 13, holder element 22, thumbwheel 24, setscrew 25 and washer 26.

The twin adjustable Tremolo Stabilizer 50 (one only is shown in profile) adapts spring holder 22 extended portion 23 to receive tensioner housing 51 further comprising guide element 52, washer 54 and fine adjustment element 55, extending through pre-loaded coil spring 53 within cooperating cavity 56 and cooperating spring block 21 cavity 57.

Pre-loaded coil spring 55 operable to exert a second variable force of tension. Two stabilizer mechanism 50, holding a second variable force of tension collectively, at least 8~10 pounds force, the second force of tension less than the first force of tension, fine adjustment element 55 positioned to make initial contact with tremolo pocket contact area 29, tremolo 10 at initial position as shown. Tremolo Stabilizer 50 pre-loaded coil spring 53 biasing element 19 first variable force of tension to increase the force required to pivot fulcrum tremolo 10 from initial position rearwardly. Threading fine adjustment element 55 is operable to establish initial contact at initial position. Threading the tensioner housing is operable to adjust the pre-load of the coil spring element. Threading the thumbwheel 24 is operable adjust the position of spring holder 22 and, thereby, the biasing element force of tension and the second variable force of tension simultaneously.

FIG. 6 shows a profile view of fulcrum tremolo 10 in a partial cross-section side view showing body 3 further comprising tremolo pocket 28, tremolo spring pocket 29, Tremolo Stabilizer 50 and locking macro-tuner 12 comprising bridge element 17, an associated tailpiece comprising tuning pin 15 variably positioned by the tuner knob to alter the tension of string 6 secured to head 2 (not shown). Second critical point 16 is located on intonation module 12. Base plate 13 pivotally support tremolo 10 on body 3. Base element 21 connected to the base plate 13, holder element 22, thumbwheel 24, setscrew 25 and washer 26. Tremolo Stabilizer 50 comprising L-shaped bent piece of flat spring steel 60 comprising a flexible bend positioned on tremolo 10 with short leg 61 between spring block element 21 and base plate 13 and longer leg 62 extending with a mild curve comprising tip 63 contacting tremolo pocket contact area 29.

Flat spring steel 60 flexible bend operable to hold a second variable force of tension, at least 8~10 pounds force, the second force of tension less than the first force of tension. Threading setscrew 51 is operable to make contact with upper leg 62 to limit the second variable force of tension. The tremolo at initial position, any tendency for sharpened pitches, including by pivoting tremolo 10 rearwardly, activates stabilizer mechanism 50 with its limited capacity to deflect spring block 53 in a direction away from nut (not shown). The flat spring Tremolo Stabilizer complements first variable force of tension of biasing element 19 to increase the force required to pivot fulcrum tremolo 10 rearwardly from initial position.

FIG. 7 show in profile view of fulcrum tremolo 10 in a partial cross-section side view showing body 3 further a novel compound flat spring biasing element with tremolo pocket 28 and tremolo spring pocket 29, Stop Tuner 20 arrangement and locking macro-tuner 12 comprising bridge element 17, an associated tailpiece comprising tuning pin 15 variably positioned by the tuner knob to alter the tension of string 6 secured to head 2 (not shown). Second critical point 16 is located on intonation module 12. Base plate 13 pivotally support tremolo 10 on body 3. String contact point 16 on bridge element 17.

Stop Tuner 20 arrangement comprising traditional spring block 21 further comprising, and moveable therewith, adjustment element 31 and set screw 25, adjustment element 34 and set screw 25 threadedly engaged with spring block 21. Adjustment element 34 comprising threaded portion 31 as shown to make initial contact with tremolo pocket contact area 29 at initial position to "stop" tremolo 10; setscrew 25 secures the position of adjustment element 34 and improves coupling between the three parts. The position of adjustment element 31 can be used to limit the range of backward pivoting for pre-determined upward pulls on the tremolo.

Further, a novel compound L-shaped flat spring biasing element formed by a first upper leg 81, first flexible bend 82, lower leg 83 and curved surfaced end 84, a second upper leg 61, second flexible bend 62, second lower leg 63 of unequal lengths like half of a "leaf spring" cut in the middle. Thicker first lower leg 63 comprising at least the major portion of the first variable force of tension and the longer thinner leaf 83 would complete the first variable force of tension requirement and provide for the second variable force of tension. Stop Tuner 20, limiting rearward pivot/upward pitch change, and the compound flat spring arrangement comprising a stabilized biasing element operable to both establish and enforce initial position when the strings are tensioned to play.

FIG. 8 shows a profile view of fulcrum tremolo 10 in a partial cross-section side view showing body 3 further comprising tremolo pocket 28 and tremolo spring pocket 29, single Tremolo Stabilizer 50 and locking macro-tuner 12 comprising bridge element 17, an associated tailpiece comprising tuning pin 15 variably positioned by the tuner knob to alter the tension of string 6 secured to head 2 (not shown). Second critical point 16 is located on intonation module 12. Base plate 13 pivotally support tremolo 10 on body 3. String contact point 16 on bridge element 17. Base element 21 connected to the base plate 13, holder element 22, thumbwheel 24, setscrew 25 and washer 26.

Single adjustable Tremolo Stabilizer 50 added to spring block 21 comprises tensioner 51 threadedly engaged with extended portion 23 formed to receive washer 54 and pre-tensioned compression spring 54 operable to exert force on fine adjuster 55, theadedly supported by guide element 52, to make variable contact with tremolo pocket contact area 29 of body 3. Threading tensioner 51 is operable to vary pre-tension at initial contact and threading fine adjuster 55 within guide element 52 is operable to variably adjust to tremolo pocket contact area 29 at initial position to stabilize tremolo 10. Single pre-tensioned compression spring 54 comprises at least 8~10 pounds force. Any tendency for sharpened pitches, by pivoting tremolo 10 lightly and/or bending string 6, etc. activates stabilizer mechanism 50 with its limited capacity to urge spring block 21 in a direction away from nut 7 (not shown) against tremolo pocket contact area 29, tremolo 10 at initial position. Stabilizer 50 pre-loaded coil spring 53 biasing element 19 first variable force of tension to increase the force required to pivot fulcrum tremolo 10 from initial position rearwardly. Threading fine adjustment element 55 is operable to establish initial contact at initial position. Threading the tensioner housing is operable to adjust the pre-load of the coil spring element.

FIG. 9 shows in profile tremolo 10 with novel Tremolo Spring comprising an L-shaped flat spring 60, Global Tuner thumbwheel 24, and at least a single adjustable Tremolo Stabilizer 50 represented with tensioner 52 and contact pin 55 (see in FIGS. 4, 5 and 8 for greater detail).

Further, Tremolo Spring comprising a first upper leg, the first upper leg secured to the instrument, flexible bend 62, lower leg 63 including a curved portion 80 extending to variably meet body 3 at first variable contact area 65, the L-shaped flat spring 60 operable to hold a first variable force of tension at initial position.

A Global Tuner arrangement is shown with a global tuner thumbwheel 24 rotatably supported by base element 21. Thumbwheel 24 shaft further comprising a cylindrically shaped tensioner element 66 comprising cam-like surface 70. Tensioner curved spring element 72 having a first curved end 73, wherein first curved end 74 pivotably mounted within second recess 71 and second curved end 73 pivotably mounted within second recess 73 in the base element 21. At least a portion 72 of the flexible curved portion operable to contact the first L-shaped spring 61 at second variable contact point 75 closer to the flexible bend 62 than to the tip 80. Cam-like surface 70 in variable contact with first end 73 of tensioner spring 72 within first recess 68. Rotating global tuner thumbwheel 24 is operative to rotate the cam-like portion 70 to adjust first end 73 and, thereby, adjust the first variable force of tension.

The various features of novelty, which characterize the invention, are intended to improve the upward spiral of Light and are pointed out with particularity in the claims annexed to and forming a part of this disclosure. For a better understanding of the invention, its operating advantages and specific objects attained by its use, reference should be had by the accompanying drawings and descriptive matter in which there are illustrations and described preferred embodiments of the invention.

While specific embodiments of the invention have been shown and described in detail to illustrate the application of the inventive principles, it will be understood that the invention may be embodied otherwise without departing from such principles.

I claim:

1. A fulcrum tremolo for a stringed musical instrument, the stringed musical instrument comprising a body, the body further comprising a top surface and a back surface, the top surface generally parallel to the back surface, a plurality of strings extending in a direction from the body to the neck, the top surface and the back surfaces extending in the direction of the plurality of strings, a neck extending outwardly from the body, the neck further comprising a head, the head operable to variably secure each of the plurality of strings, a nut to form a first critical point for each of the plurality strings, a bridge element forming a second critical point for supporting each associated string of the plurality of strings on the top surface of the body and a tailpiece for securing a plurality of strings to the body, the bridge element adjustably secured to the body for intonating the associated string, each of the plurality of strings intonated collectively comprising harmonic tuning, a tailpiece element, the tailpiece element further securing the plurality of strings to the body, each associated string of the plurality of strings operable to be tensioned to pitch for play, strings tensioned for play comprises string force of tension, strings tensioned for play comprising harmonic tuning, a fulcrum tremolo, the fulcrum tremolo pivotally mounted on the body for pivotally supporting the plurality of strings, the fulcrum tremolo comprising a tremolo pivot axis, the body further comprising a cavity formed to receive a fulcrum tremolo, the cavity further comprising a tremolo pocket, the tremolo pocket extending from the top surface to the back surface, the tremolo pocket comprising at least one face, the at least one face generally perpendicular to the top surface of the body, the at least one face transverse the direction of the plurality of strings, the tremolo pocket to allow the spring block to pivot freely, the cavity further comprising a tremolo spring pocket, the spring pocket formed in the back of the body to receive the biasing element, the fulcrum tremolo operable to be pivoted rearward to increase tension and pitch of each of the plurality of strings, and forward to decrease tension and pitch of each of strings, the fulcrum tremolo further comprising an apparatus, the apparatus secured to the fulcrum tremolo and moveable therewith around the pivot axis, the fulcrum tremolo operable to pivot freely within the body cavity, the fulcrum tremolo comprising:

a base plate comprising:

a first side furthest the body, a second side closer the body, a spring block, the spring block secured to, and moveable therewith, the fulcrum tremolo base plate, a first opening further comprising a threaded opening, the apparatus further comprising:

a formed flat spring element, the formed flat spring element comprising a upper leg, the upper leg variably attached to the spring block, a lower leg, the lower leg extending in the direction of the strings, at least a portion of the formed flat spring comprising at least a portion of a flexible bend, the formed flat spring element operable to hold a variable force of tension against at least one face at initial position, the lower leg in first variable contact with the body, the at least one face further comprising a tremolo pocket contact area, the adjustment element free end operable to contact the tremolo pocket contact area, wherein the fulcrum tremolo at initial position, strings tensioned for play, the apparatus to limit one direction of pivoting.

2. The apparatus of claim 1 wherein:

the spring block further comprising a base element, the base element generally perpendicular to the base plate second side, the base element comprising:

a connecting end, the connecting end closest the base plate, a supporting end, the support end furthest the base plate, the support end comprising the first opening, a holder element, the holder element comprising a second opening, the second opening aligned to the first opening, the holder element transverse the direction of the strings, the holder element variably connected to the supporting end, the holder element further comprising:

an extended portion, the extended portion transverse the direction of the strings extending from the biasing end in the direction of the second side, the extended portion operable to make initial contact with the tremolo pocket contact area at initial position, a thumbwheel element, the thumbwheel element comprising an elongated threaded portion, the thumbwheel element threadedly connected to the holder element second opening, wherein threading the thumbwheel element adjusts the extended portion to make variable initial contact with the tremolo pocket contact area to limit pivoting in one direction.

3. Apparatus of claim 1 wherein a biasing element, the biasing element comprising a first end and a second end, the first end connected to the fulcrum tremolo and the second end variably secured to the body, the biasing element operable to hold a first variable force of tension, the shaped flat spring element operable to hold a second variable force of tension, the base plate further comprising a base element, the base element generally perpendicular to the base plate second side, the base element comprising:

a connecting end, the connecting end closest the base plate, a supporting end, the support end furthest the base plate, the support end comprising the first opening, the at least one face further comprising a tremolo pocket contact area, the tremolo pocket contact area operable to make variable contact with the shaped flat spring element free end, wherein the fulcrum tremolo at initial position, strings tensioned for play, the shaped flat spring element exerting a second variable force of tension against the at least one face to limit the first variable force of tension during rearward tilt position.

4. Apparatus of claim 1 wherein the spring block further comprises an adjustment setscrew, the adjustment setscrew threadedly connected to the spring block, the adjustment setscrew in variable contact with the lower leg of the L-shaped spring plate closer the connecting end than the supporting end, threading the adjustment setscrew is operable to further adjust the variable force of tension.

5. The apparatus of claim 1 wherein the formed flat spring element operable to hold a first variable force of tension, the base plate further comprising a base element, the base element generally perpendicular to the base plate second side, the base element comprising:

a connecting end, the connecting end closest the base plate, a supporting end, the support end furthest the base plate, the support end comprising the first opening, a first opening further comprising a threaded opening, an adjustable stabilizer, the adjustable stabilizer comprising a tensioner housing, the tensioner housing threadedly connected to the spring block threaded opening, the tensioner housing formed to adjustably receive:

a pre-loaded coil spring element, the pre-loaded coil spring element operable to hold a second force of tension, the second force of tension less than the first force of tension, a guide element, the guide element operable to variably support the pre-loaded coil spring element within the tensioner housing, an adjustable contact pin element, the adjustable contact pin element threadely connected to the guide element, the adjustable contact pin element further comprising a free end, threading the adjustable contact pin is operable to adjust initial contact with the body at initial position, threading the tensioner housing operable to adjust the pre-load of the coil spring element applied by the contact pin against the body, wherein the adjustable contact pin element making initial contact with the tremolo pocket contact area at initial position, the adjustable stabilizer element second variable force of tension limits the first variable force of tension.

6. An apparatus for a stringed musical instrument, the stringed musical instrument comprising a body, the body further comprising a top surface and a back surface, the top surface generally parallel to the back surface, a plurality of strings extending in a direction from the body to the neck, the top surface and the back surfaces extending in the direction of the strings, a neck extending outwardly from the body, the neck further comprising a head, the head operable to variably secure each of the plurality of strings, a nut to form a first critical point for each of the plurality of strings, a bridge element forming a second critical point for supporting each associated string of the plurality of strings adjustably secured to the body for intonating the associated string, each associated string of the plurality of strings intonated collectively comprising harmonic tuning, and a tailpiece for securing a plurality of strings to the body, a fulcrum tremolo pivotally mounted on the body for pivotally supporting the plurality of strings, a pivot axis for the fulcrum tremolo, the body further comprising a cavity formed to receive a fulcrum tremolo, the cavity further comprising a tremolo pocket, the tremolo pocket extending from the top surface to the back surface, the tremolo pocket comprising at least one face, the at least one face generally perpendicular to the top surface of the body, the tremolo pocket to allow the spring block to pivot freely, the cavity further comprising a tremolo spring pocket, the spring pocket formed in the back of the body to receive the biasing element, the fulcrum tremolo operable to be pivoted rearward to increase tension and pitch of each of the plurality of strings, and to be pivoted forward to decrease tension and pitch of each of the plurality of strings, each associated string of the plurality of strings operable to be tensioned to pitch for play, strings tensioned for play comprising string force of tension, the apparatus secured to the fulcrum tremolo and moveable therewith around the pivot axis, the fulcrum tremolo operable to pivot freely within the body cavity, the fulcrum tremolo comprising:

a base plate comprising:

a first side furthest the body, a second side closer the body, a first opening further comprising a threaded opening, a biasing element, the biasing element comprising a first end and a second end, the first end connected to the fulcrum tremolo and the second end connected to the body, the biasing element operable to hold a first force of tension, a spring block, the spring block secured to, and moveable therewith, the fulcrum tremolo base plate, the spring block operable to receive the first end of the biasing element, the apparatus comprising:

a resilient spring element, the resilient spring element further comprising at least a portion of a flexible bend, the at least a portion of a flexible bend operable to hold a variable force of tension, the resilient spring element extending in a direction of the strings, at least one face further comprising a tremolo pocket contact area, the tremolo pocket contact area operable to receive variable contact from the resilient element, wherein the fulcrum tremolo at initial position, strings tensioned for play, the apparatus operable to contact the body, the apparatus operable to hold the variable force of tension against the tremolo pocket at least one face.

7. The apparatus of claim 6 wherein the resilient spring element at least a portion of a bend comprising a pre-loaded coil spring element, the apparatus further comprising:

at least one spring tensioner element, the at least one spring tensioner element threadedly connected to the spring block threaded opening, the at least one spring tensioner element formed to adjustably receive the pre-loaded coil spring element, the at least one spring tensioner element to pre-load and adjust the force of the tension held by the pre-loaded coil spring element, the at least one spring tensioner element further formed to adjustably receive:

a guide element, the guide element operable to variably support the a pre-loaded coil spring element, an adjustable contact pin element, the adjustable contact pin element threadely connected to the guide element, the adjustable contact pin element further comprising a tip, threading the adjustable contact pin element operable to adjust the tip, wherein the adjustable contact pin element operable to make initial contact with the tremolo pocket contact area at initial position.

8. The apparatus of claim 6 wherein:

the spring block further comprises a base element, the base element generally perpendicular to the base plate second side, the spring block further comprising a first opening the base element comprising:

a connecting end, the connecting end closest the base plate, a supporting end, the supporting end furthest the base plate, the spring block further comprising a separate holder element, the separate holder element comprising a threaded opening, the threaded opening aligned to the first opening, the separate holder element transverse the direction of the strings, the separate holder element variably connected to the supporting end and the first end, the separate holder element further comprising:

a biasing end, the biasing end further the base plate, the biasing end formed to receive the first end of the biasing element, an extended portion, the extended portion transverse the direction of the strings, extending from the biasing end in the direction of the second side, the extended portion operable, the resilient spring element secured to the extended portion, a thumbwheel element, the thumbwheel element comprising an elongated threaded portion, the thumbwheel element connected to the first opening, the adjustment element threadedly connected to the holder element threaded opening, the adjustment element connected to first opening, threading the adjustment element adjusts the extended portion in the direction of the strings.

9. Apparatus of claim 8 wherein the variable force of tension is equal to the first force of tension.

10. Apparatus of claim 8 wherein the variable force of tension comprises a second force of tension, the second force of tension less than the first force of tension.

11. A fulcrum tremolo for a stringed musical instrument, the stringed musical instrument comprising a body, the body further comprising a top surface and a back surface, the top surface generally parallel to the back surface, a plurality of strings extending in a direction from the body to the neck, the top surface and the back surfaces extending in the direction of the strings, a neck extending outwardly from the body, the neck further comprising a head, the head operable to variably secure each of the plurality of strings, a nut to form a first critical point for each of the plurality of strings, a bridge element forming a second critical point for supporting each associated string of the plurality of strings on the top surface of the body and a tailpiece for securing a plurality of strings to the body, the bridge element adjustably secured to the body for intonating the associated string, each of the plurality of strings intonated collectively comprising harmonic tuning, a tailpiece element, the tailpiece element further securing the plurality of strings to the body, each associated string of the plurality of strings operable to be tensioned to pitch for play, strings tensioned for play comprises string force of tension, strings tensioned for play comprising harmonic tuning, a fulcrum tremolo, the fulcrum tremolo pivotally mounted on the body for pivotally supporting the plurality of strings, the fulcrum tremolo comprising a tremolo pivot axis, the body further comprising a cavity formed to receive a fulcrum tremolo, the cavity further comprising a tremolo pocket, the tremolo pocket extending from the top surface to the back surface, the tremolo pocket comprising at least one face, the at least one face generally perpendicular to the top surface of the body, the tremolo pocket to allow the spring block to pivot freely, the cavity further comprising a tremolo spring pocket, the spring pocket formed in the back of the body to receive the biasing element, the fulcrum tremolo operable to be pivoted rearward to increase tension and pitch of each of the plurality of strings, and forward to decrease tension and pitch of each of the plurality of strings, the fulcrum tremolo further comprising an apparatus, the apparatus secured to the fulcrum tremolo and moveable therewith around the pivot axis, the fulcrum tremolo operable to pivot freely within the body cavity, the fulcrum tremolo comprising:

a base plate comprising:

a first side furthest the body, a second side closer the body, the base plate further operable to receive the first end of the biasing element, a biasing element, the biasing element comprising a first end and a second end, the first end connected to the fulcrum tremolo and the second end operable to variably contact the body, the biasing element operable to hold a first variable force of tension, the biasing element further comprising:

a shaped flat spring element, at least a portion of the shaped flat spring element comprising at least a portion of a flexible bend, the at least a portion of a flexible bend operable to hold a first variable force of tension, the shaped flat spring element further comprising a first end, the first end variably attached to the base plate, the shaped flat spring element comprising a second end, the second end further comprising curved contact bend, the shaped flat spring element operable to make contact with the body, the body face further comprising a variable contact area, the variable contact area operable to receive variable contact from the curved contact bend, wherein the fulcrum tremolo at initial position, strings tensioned for play, the resilient spring element first variable force of tension limits one direction of pivoting.

12. Apparatus of claim 9 wherein the shaped flat spring element comprises a formed L-shaped flat spring.

13. The apparatus of claim 11 wherein:

a mounting element, the mounting element having a tuning face generally perpendicular to the base plate second side, the mounting element transverse the direction of the strings, the mounting element comprising:

a connecting end, the connecting end closest the base plate, a supporting end, the support end furthest the base plate, the support end comprising a first opening, a spring contact tensioner element, the spring contact tensioner element comprising a second opening, the second opening aligned to the first opening, the spring contact tensioner element transverse the direction of the strings, the spring contact tensioner element variably connected to the supporting end, the spring contact tensioner element variably connected to the curved contact bend, a thumbwheel element, the thumbwheel element comprising an elongated threaded portion, the thumbwheel element threadedly connected to the spring contact tensioner element second opening, wherein threading the thumbwheel element adjusts the spring contact tensioner element to adjust the at least a portion of the flexible bend and, thereby, the first variable force of tension.

14. Apparatus of claim 13 wherein thumbwheel element comprises a global tuner arrangement, the global tuner arrangement comprising:

a base element, the base element generally transverse the direction of the strings, the base element secured to the instrument, a spring tensioner element, the spring tensioner transverse the direction of the strings, the string tensioner element variably connected to the base element, the string tensioner further having a spring side surface, a global tuner thumbwheel, a global tuner thumbwheel having a thumbwheel shaft, the thumbwheel shaft in the direction of the strings, the base element supporting the a thumbwheel shaft, wherein the base element is further formed to either:

1) threadedly receive the global tuner thumbwheel, the global tuner thumbwheel shaft comprising an end, the end variably contacting the spring tensioner, the spring side surface generally parallel with the at least one face, the spring side surface in first variable contact with the curved contact bend, threading the global tuner thumbwheel is operable to adjust at least a portion of a flexible bend, Or, 2) rotatably secure the global tuner thumbwheel, a portion of the thumbwheel shaft further formed to include a cam-like portion, the cam-like portion operable to rotate with the global tuner thumbwheel element, the cylindrical cam-like portion comprising the spring side surface, the spring side surface generally transverse the direction of the first face, further, a curved second flat spring element, the curved second flat spring element comprising a first curved end and a second curved end, the cam-like spring side surface in variable contact with the first curved end, the second curved end variably secured to the tremolo, the curved second flat spring in second variable contact with the second face of the first flat spring element, rotating the global tuner thumbwheel, and, thereby, the cam-like spring side surface, is operable to adjust the curved second flat spring in second variable contact with the second face, the second variable contact closer the base plate than the first end portion, wherein turning the global tuner thumbwheel varies the first force of tension to achieve initial position.

15. The apparatus of claim 12 wherein the base plate further comprising a base element, the base element generally perpendicular to the base plate second side, the base element comprising:

a connecting end, the connecting end closest the base plate, a supporting end, the support end furthest the base plate, the support end comprising the first opening, wherein the spring block first opening further comprising a threaded opening, an adjustable stabilizer, the adjustable stabilizer comprising a tensioner housing, the tensioner housing threadedly connected to the spring block threaded opening, the tensioner housing formed to adjustably receive:

a pre-loaded coil spring element, the pre-loaded coil spring element operable to hold a variable force of tension, a guide element, the guide element operable to variably support the pre-loaded coil spring element within the tensioner housing, an adjustable contact pin element, the adjustable contact pin element threadely connected to the guide element, the adjustable contact pin element further comprising a free end, threading the adjustable contact pin is operable to adjust initial contact with the body at initial position, threading the tensioner housing operable to adjust the pre-load of the coil spring element applied by the contact pin against the body, wherein the adjustable contact pin element making initial contact with the tremolo pocket contact area at initial position, the adjustable stabilizer element pre-loaded variable force of tension limits the first variable force of tension.

16. Apparatus of claim 11 wherein the base plate further comprising a base element, the base element generally perpendicular to the base plate second side, the base element comprising:

a connecting end, the connecting end closest the base plate, a supporting end, the support end furthest the base plate, the support end comprising the first opening, the resilient spring element comprising a shaped flat spring element, the shaped flat spring element secured to the tremolo, the resilient spring element operable to hold a second force of tension, the second force of tension less than the first force of tension, the shaped flat spring element further comprising the free end, the shaped flat spring element free end operable to make initial contact with the at least one face at initial position, the at least one face further comprising a tremolo pocket contact area, the tremolo pocket contact area operable to receive variable contact from the shaped flat spring element free end, wherein the fulcrum tremolo at initial position, strings tensioned for play, the shaped flat spring element exerting a second variable force of tension against the at least one face, the additional stabilizer element limits the first variable force of tension.

17. A fulcrum tremolo for a stringed musical instrument, the stringed musical instrument comprising a body, the body further comprising a top surface and a back surface, the top surface generally parallel to the back surface, a plurality of strings emending in a direction from the body to the neck, the top surface and the back surfaces extending in the direction of the strings, a neck extending outwardly from the body, the neck further comprising a head, the head operable to variably secure each of the plurality of strings, a nut to form a first critical point for each of the plurality strings, a bridge element forming a second critical point for supporting each associated string of the plurality of strings on the top surface of the body and a tailpiece for securing a plurality of strings to the body, the bridge element adjustably secured to the body for intonating the associated string, each of the plurality of strings intonated collectively comprising harmonic tuning, a tailpiece element, the tailpiece element further securing the plurality of strings to the body, each associated string of the plurality of strings operable to be tensioned to pitch for play, strings tensioned for play comprises string force of tension, strings tensioned for play comprising harmonic tuning, a fulcrum tremolo, the fulcrum tremolo pivotally mounted on the body for pivotally supporting the plurality of strings, the fulcrum tremolo comprising a tremolo pivot axis, the body further comprising a cavity formed to receive a fulcrum tremolo, the cavity further comprising a tremolo pocket, the tremolo pocket extending from the top surface to the back surface, the tremolo pocket comprising at least one face, the at least one face generally perpendicular to the top surface of the body, the tremolo pocket to allow the spring block to pivot freely, the cavity further comprising a tremolo spring pocket, the spring pocket formed in the back of the body to receive the biasing element, the fulcrum tremolo operable to be pivoted rearward to increase tension and pitch of each of the plurality of strings, and forward to decrease tension and pitch of each of the plurality of strings, the fulcrum tremolo further comprising an apparatus, the apparatus secured to the fulcrum tremolo and moveable therewith around the pivot axis, the fulcrum tremolo operable to pivot freely within the body cavity, the fulcrum tremolo comprising:

a base plate comprising:

a first side furthest the body, a second side closer the body, a biasing element, the biasing element comprising a first end and a second end, the first end connected to the fulcrum tremolo and the second end connected to the body, the biasing element operable to hold a first variable force of tension, the apparatus comprising the biasing element, the biasing element comprising a first flat spring element, the first flat spring element comprising a first flexible bend operable to provide the first variable force of tension, the first flexible bend transverse the direction of the strings and generally parallel to the tremolo axis, the first formed flat spring element having generally planar surfaces forming a first face closer to the body and a second face closer at least a portion of a tremolo, the first flat spring element comprising a first upper leg, the first upper leg secured to the tremolo, a first lower leg, the first lower leg extending to a first end portion in a direction towards the body, the first flat spring element having a first material thickness, wherein strings tensioned for play, the first variable force of tension essentially equal to string tension at initial position, at least a portion of a first face of the first end portion forming a first variable contact with the body to achieve initial position and variably support the pivoting of tremolo.

18. The apparatus of claim 16 wherein the first flat spring element comprising a first L-shape, the first L-shape comprising the first lower leg in first variable contact with the body.

19. The apparatus of claim 16 wherein at least a portion of a first face comprising a second bend, the second bend forming a first curved surface, the first curved surface operable to form the first variable contact.

20. The apparatus of claim 17 further comprising a second flat spring element, the second flat spring element comprising a second L-shape, the second flat spring element comprising a second material thickness, the second flat spring element comprising the second lower leg, the first material thickness is less than the second material thickness, the second flat spring element operable to hold a second variable force of tension, the second variable force of tension less than the first variable force of tension, wherein the first lower leg is shorter than the second lower leg, the first lower leg comprising at least the major portion of the first variable force of tension and the second lower leg augmenting the first variable force of tension to establish initial position, the second lower leg operable to comprise the first variable contact with the body.

21. Apparatus of claim 18 wherein a global tuner arrangement, the global tuner arrangement comprising:

a base element, the base element generally transverse the direction of the strings, the base element secured to the instrument, a spring tensioner element, the spring tensioner transverse the direction of the strings, the string tensioner element variably connected to the base element, the string tensioner further having a spring side surface, a global tuner thumbwheel, a global tuner thumbwheel having a thumbwheel shaft, the thumbwheel shaft in the direction of the strings, the base element supporting the a thumbwheel shaft, wherein the base element is further formed to either:

1) threadedly receive the global tuner thumbwheel, the global tuner thumbwheel shaft comprising an end, the end variably contacting the spring tensioner, the spring side surface generally parallel with the first face, the spring side surface in first variable contact with the first lower leg, threading the global tuner thumbwheel is operable to adjust the spring side surface in first variable contact with lower leg, Or, 2) rotatably secure the global tuner thumbwheel, a portion of the thumbwheel shaft further formed to include a cam-like portion, the cam-like portion operable to rotate with the global tuner thumbwheel element, the cylindrical cam-like portion comprising the spring side surface, the spring side surface generally transverse the direction of the first face, further, a curved second flat spring element, the curved second flat spring element comprising a first curved end and a second curved end, the cam-like spring side surface in variable contact with the first curved end, the second curved end variably secured to the tremolo, the curved second flat spring in second variable contact with the second face of the first flat spring element, rotating the global tuner thumbwheel, and, thereby, the cam-like spring side surface, is operable to adjust the curved second flat spring in second variable contact with the second face, the second variable contact closer the base plate than the first end portion, wherein turning the global tuner thumbwheel varies the first force of tension to achieve initial position.

* * * * *